US006585051B2

(12) United States Patent
Purkis et al.

(10) Patent No.: US 6,585,051 B2
(45) Date of Patent: Jul. 1, 2003

(54) HYDRAULICALLY OPERATED FLUID METERING APPARATUS FOR USE IN A SUBTERRANEAN WELL, AND ASSOCIATED METHODS

(75) Inventors: Daniel G. Purkis, Aberdeenshire (GB); Michael A. Reid, Aberdeen (GB); Jimmie Robert Williamson, Jr., Carrollton, TX (US)

(73) Assignee: WellDynamics Inc., Spring, TX (US)

( * ) Notice: Subject to any disclaimer, the term of this patent is extended or adjusted under 35 U.S.C. 154(b) by 49 days.

(21) Appl. No.: 09/862,561

(22) Filed: May 22, 2001

(65) Prior Publication Data

US 2002/0014338 A1 Feb. 7, 2002

(51) Int. Cl.[7] ..... E21B 34/10

(52) U.S. Cl. ..... 166/374; 166/373; 166/320; 251/60; 251/205

(58) Field of Search ..... 166/373, 374, 166/386, 319, 320, 325; 251/60, 205, 63.5, 324, 321

(56) References Cited

U.S. PATENT DOCUMENTS

| | | | | | |
|---|---|---|---|---|---|
| 2,770,308 | A | * | 11/1956 | Saurenman | 137/625.64 |
| 3,763,885 | A | * | 10/1973 | Sussman | 137/556.6 |
| 4,132,205 | A | * | 1/1979 | Merritt | 123/446 |
| 4,180,239 | A | * | 12/1979 | Valukis | 251/205 |
| 5,238,070 | A | * | 8/1993 | Schultz et al. | 166/319 |
| 5,564,501 | A | * | 10/1996 | Strattan et al. | 166/321 |
| 5,746,413 | A | * | 5/1998 | Goloff | 251/129.15 |
| 5,897,095 | A | | 4/1999 | Hickey | |
| 5,906,220 | A | * | 5/1999 | Thompson | 137/488 |
| 6,276,458 | B1 | | 8/2001 | Malone et al. | |
| 2001/0037884 | A1 | * | 11/2001 | Schultz et al. | 166/378 |

FOREIGN PATENT DOCUMENTS

| | | | |
|---|---|---|---|
| FR | 2270468 | 12/1975 | |
| GB | 1135895 | 12/1968 | |
| GB | 1345867 | 2/1974 | |
| GB | 2335216 A * | 9/1999 | E21B/34/10 |

OTHER PUBLICATIONS

International Search Report Application No.: PCT/US00/14027.

* cited by examiner

*Primary Examiner*—David Bagnell
*Assistant Examiner*—Thomas Bomar
(74) *Attorney, Agent, or Firm*—Marlin Smith

(57) ABSTRACT

A hydraulically operated fluid metering apparatus provides discharge of a known volume of fluid to an actuator of a well tool. In one described embodiment, the fluid metering apparatus is connected to a hydraulic input of a well tool actuator. Discharge of the known volume of fluid to the actuator input causes a piston of the actuator to displace a known distance, thereby producing a known increment of actuation of the well tool. The discharge of the known volume of fluid may be repeated to produce a desired total degree of actuation of the well tool.

48 Claims, 19 Drawing Sheets

10
40
34
36
38
12
26
24
20
14
28
24
20
16
30
24
20
18
32
24
20

HYDRAULICALLY OPERATED FLUID METERING APPARATUS FOR USE IN A SUBTERRANEAN WELL, AND ASSOCIATED METHODS

CROSS-REFERENCE TO RELATED APPLICATION

The present application claims the benefit under 35 USC §119 of the filing date of PCT International Application No. PCT/US00/14027, filed May 22, 2000, the disclosure of which is incorporated herein by this reference.

BACKGROUND

The present invention relates generally to operations performed and equipment utilized in conjunction with subterranean wells and, in an embodiment described herein, more particularly provides a system for hydraulically controlling actuation of downhole tools.

It is highly advantageous to be able to adjust the rate of fluid flow between a formation or zone intersected by a well and a tubular string positioned in the well. For example, a well tool known as a choke may be interconnected in the tubular string and a flow area for flow from the zone to the interior of the tubular string may be altered to thereby change the rate of fluid flow between the zone and the tubular string. Such adjustments of flow rate may be needed to prevent water encroachment, balance production from various zones of a producing formation, control injection of fluid into a zone, etc.

Changing the rate of fluid flow through a downhole choke has been accomplished in the past using various methods. In one method, a signal is transmitted via conductors to the choke to permit fluid communication between an actuator of the choke and hydraulic control lines. A position sensor of the choke transmits a signal to indicate when the choke has been adjusted as desired. In another method, a shifting tool is conveyed into the choke and a member of the choke is displaced by the shifting tool to change the flow area through the choke.

Unfortunately, each of these methods has drawbacks. The former method requires electrical conductors, downhole electrical circuits and downhole position sensors, and is thus fairly sophisticated, complex and expensive. The latter method requires physical intervention into the well, which typically requires that the well be shut in and a wireline, slickline or coiled tubing rig be mobilized to perform the operation.

However, since a hydraulic actuator may be used to control a downhole choke, and a known volume of fluid injected into the hydraulic actuator may be used to produce a predictable displacement of a member of the choke, what is needed is a hydraulically operated fluid metering apparatus to inject the known volume of fluid into the actuator. To produce a desired total displacement of the choke member, multiple injections of the known volume of fluid may be used to incrementally displace the member in response to each injection. Such an apparatus could also be used in actuation of other types of well tools, for example, valves, orientation apparatus, etc. The apparatus should not require downhole sensors or physical intervention into the well for its operation.

SUMMARY

In carrying out the principles of the present invention, in accordance with an embodiment thereof, a hydraulically operated fluid metering apparatus is provided which permits controlled incremental actuation of a well tool downhole. The apparatus does not require a position sensor or intervention into the well for its operation, but enables accurate and convenient actuation of the well tool. Associated methods of hydraulically controlling actuation of well tools are also provided.

In one aspect of the present invention, a fluid metering apparatus is provided in which pressure applied in an appropriate sequence to two hydraulic inputs produces a discharge of a known volume of fluid from a hydraulic output of the apparatus. Pressure applied to the inputs in another sequence maybe used to cause discharge of fluid from another output of the apparatus. The inputs are in fluid communication with respective opposite sides of a piston of the apparatus.

When pressure is applied to one of the inputs, the piston displaces, admitting a known volume of fluid from the input into a chamber of the apparatus. When pressure is applied to the other input, the piston displaces in an opposite direction, thereby discharging the fluid through an associated output of the apparatus. The output is connected to a hydraulic input of an actuator, so that discharge of the known volume of fluid produces a known displacement of a piston of the actuator.

When pressure is applied to one of the fluid metering apparatus inputs, causing the piston of the fluid metering apparatus to sealingly engage a housing of the fluid metering apparatus with the piston at a reduced diameter, and pressure is also applied to the other fluid metering apparatus input, fluid is discharged from another hydraulic output of the fluid metering apparatus. This other fluid metering apparatus output is connected to another hydraulic input of the actuator, so that the fluid discharge from the output may be used to displace the actuator piston in an opposite direction.

In another aspect of the present invention, a fluid metering apparatus is provided which includes a piston assembly and a valve operative in response to displacement of the piston assembly. Pressure applied to an input of the fluid metering apparatus causes the piston assembly to displace a known distance with the valve closed, thereby discharging a known volume of fluid from an internal chamber to an output of the apparatus. The apparatus output may be connected to a hydraulic input of an actuator, so that a known displacement of a piston of the actuator is produced from the discharged known volume of fluid.

When the pressure is relieved from the metering apparatus input, the piston retracts, causing the valve to open and admitting fluid into the chamber. The valve closes again when the piston is retracted. The pressure may be applied again to the fluid metering apparatus input to discharge another known volume of fluid to the actuator input. A separate fluid metering apparatus may be connected to another hydraulic input of the actuator for use in displacing the actuator piston incrementally in an opposite direction, if desired.

The above fluid metering apparatuses may be used alone, or they may be interconnected to hydraulic lines which extend to other fluid metering apparatuses. If multiple fluid metering apparatuses are used with respective multiple well tools, the fluid metering apparatuses may be operated simultaneously, or they may be independently controlled, for example, by using an addressable actuation control apparatus, actuation control module, etc., to thereby permit independent actuation of the well tools.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
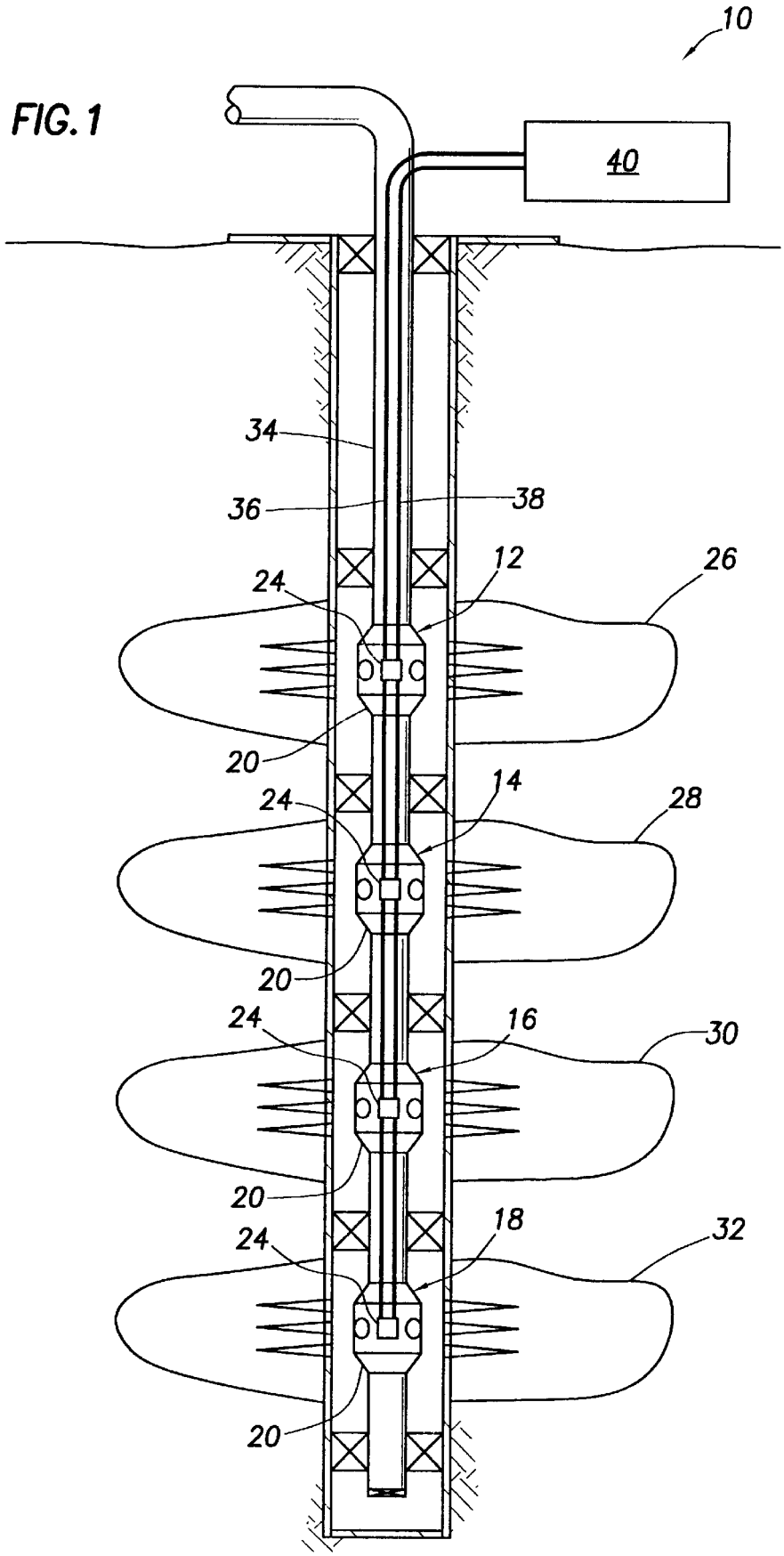
FIG. 1 is a schematic view of a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, multiple well tool assemblies 12, 14, 16, 18 are positioned in a well. As depicted in FIG. 1, each of the well tool assemblies 12, 14, 16, 18 includes a well tool 20, an actuator 22 for operating the well tool (not visible in FIG. 1, see FIGS. 2A&B and 4A&B) and an actuation control module 24. The well tool 20 of each of the assemblies 12, 14, 16, 18 representatively illustrated in FIG. 1 is shown as a valve, the valves being used in the method 10 for controlling fluid flow between formations or zones 26, 28, 30, 32 intersected by the well and a tubular string 34 in which the tool assemblies are interconnected. However, it is to be clearly understood that other types of well tools and well tool assemblies may be utilized, without departing from the principles of the present invention, and it is not necessary for the well tool assemblies to be interconnected in a tubular string or for the well tool assemblies to be used for controlling fluid flow.

Each of the tool assemblies 12, 14, 16, 18 is connected to hydraulic lines 36, 38 extending from a hydraulic control unit 40 at the earth's surface or other remote location. The hydraulic control unit 40 is of the type well known to those skilled in the art which is capable of regulating fluid pressure on the hydraulic lines 36, 38. The control unit 40 may be operated manually or by computer, etc., and may perform other functions as well.

Preferably, the tool assemblies 12, 14, 16, 18 are Interval Control Valves commercially available from Halliburton Energy Services, Inc. and well known to those skilled in the art, which are useful in regulating fluid flow rate therethrough in the manner of flow chokes. That is, the valves 20 may each variably restrict fluid flow therethrough, rather than merely permit or prevent fluid flow therethrough, so that an optimal flow rate for each of the zones 26, 28, 30, 32 may be independently established. To vary the restriction to fluid flow, the Interval Control Valve includes a flow choking member which is displaced by a hydraulic actuator, such as the actuator 22 depicted schematically in FIGS. 2A&B and 4A&B.

In order to control the restriction to fluid flow through one of the valves 20, a known volume of fluid is displaced into its associated actuator 22. The introduction of this known volume of fluid into the actuator 22 produces a known displacement of a piston 42 of the actuator which, according to conventional practice, is connected to a member of the valve 20 that is used to restrict fluid flow therethrough. Thus, the introduction of the known volume of fluid into the actuator 22 results in a predictable change in the restriction to fluid flow through the valve 20.

A desired total change in flow restriction may be accomplished by repeating the introduction of the known volume of fluid into the actuator 22 an appropriate number of times. For convenience in the following further description of embodiments of the present invention, it will be considered that fluid introduced into an upper chamber 44 of the actuator 22 causes the piston 42 to displace downwardly, thereby increasing the restriction to fluid flow through the valve 20, and fluid introduced into a lower chamber 46 of the actuator causes the piston to displace upwardly, thereby reducing the restriction to fluid flow through the valve. However, it is to be clearly understood that this configuration of the actuator 22 and valve 20 is not necessary in keeping with the principles of the present invention.

Figure 2A:
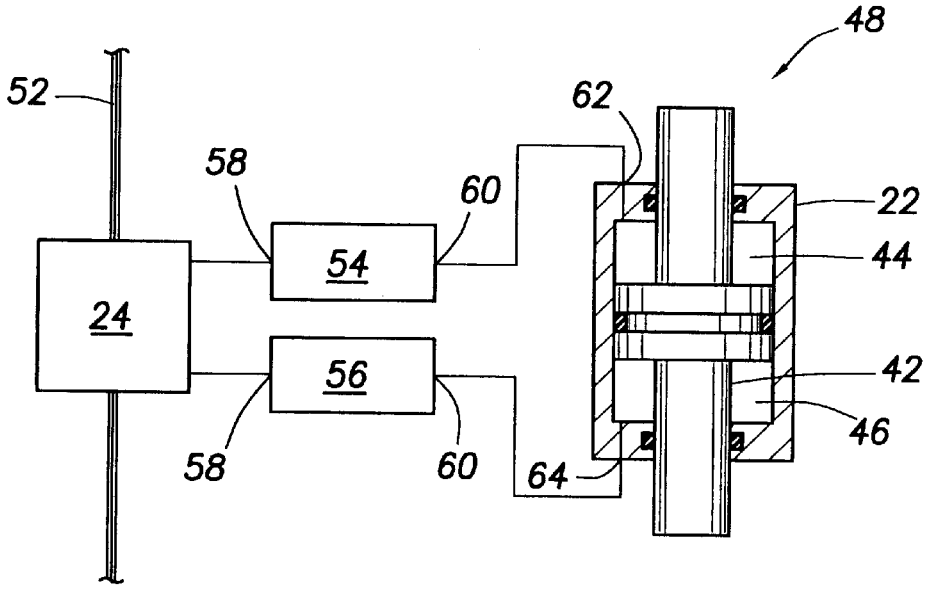
FIGS. 2A&B are schematic views of a first hydraulically operated well tool actuation system usable in the method of FIG. 1.

Referring additionally now to FIGS. 2A&B, alternate configurations of hydraulically operated well tool actuation systems 48, 50 usable in the method 10 and embodying principles of the present invention are representatively and schematically illustrated. Of course, the systems 48, 50 may be used in other methods without departing from the principles of the present invention. The system 48 is representative of a situation in which multiple well tool assemblies (such as the tool assemblies 12, 14, 16, 18) are used in a well and the actuation control module 24 of each is capable of determining when the corresponding valve 20 has been selected for actuation thereof. The system 50 is representative of a situation in which one or more well tool assemblies are used in a well without the capability of independently selecting a corresponding valve for actuation thereof.

In FIG. 2A it may be seen that the control module 24 is interconnected to multiple control lines 52. The lines 52 may include only hydraulic lines, such as the lines 36, 38, or additional lines or other types of lines, such as electrical conductors, fiber optic lines, etc., may be used. Preferably, the control module 24 responds to certain pressure levels or pressure pulses on the lines 52 to determine when the corresponding valve 20 has been selected for actuation thereof. However, the control module 24 could respond to other types of input, such as electrical or optical signals, etc.

When the control module 24 determines that the associated valve 20 has been selected for actuation thereof, the control module permits fluid communication between one of the lines 52 and one of a pair of fluid metering apparatuses 54, 56. The fluid metering apparatus 54 is selected if it is desired to introduce fluid into the upper chamber 44 to downwardly displace the piston 42 and increase the restriction to fluid flow through the corresponding valve 20. The fluid metering apparatus 56 is selected if it is desired to introduce fluid into the lower chamber 46 to upwardly displace the piston 42 and decrease the restriction to fluid flow through the corresponding valve 20.

Once fluid communication between one of the lines 52 and one of the fluid metering apparatuses 54, 56 is established, pressure on the line is increased. The pressure is transmitted through the control module 24 to a hydraulic input port 58 of the selected apparatus 54 or 56. The selected apparatus 54 or 56 responds to the increase in pressure by discharging a known volume of fluid from a hydraulic output port 60 of the selected apparatus.

The output 60 of the selected apparatus 54 or 56 is in fluid communication with either a hydraulic input port 62 or a hydraulic input port 64 of the actuator 22, which is in fluid communication with a respective one of the chambers 44, 46. Thus, an increase in pressure at the input 58 of the apparatus 54 produces a discharge of a known volume of fluid into the upper chamber 44, thereby increasing the restriction to fluid flow through the corresponding valve 20, and an increase in pressure at the input 58 of the apparatus 56 produces a discharge of a known volume of fluid into the lower chamber 46, thereby decreasing the restriction to fluid flow through the valve.

Figure 2B:
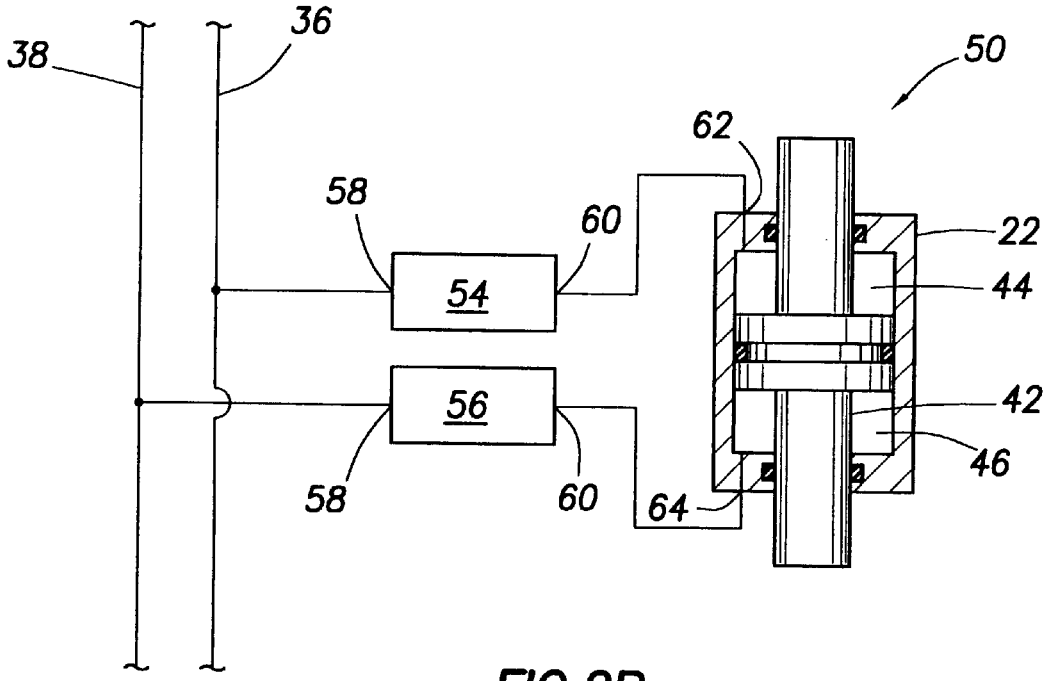

In FIG. 2B, it may be seen that the system 50 does not utilize the control module 24 for selecting from among multiple valves 20 for actuation thereof. Instead, the apparatuses 54, 56 are interconnected directly to respective ones of the lines 36, 38. Thus, the apparatuses 54, 56 will respond to pressure increases on respective ones of the lines 36, 38, without the need to select the corresponding valve 20 for actuation thereof. However, there may be one or more additional tool assemblies interconnected to the lines 36, 38, in which case the additional tool assemblies may be actuated simultaneously in response to pressure applications on the lines.

An increase in pressure on the line 36 will cause discharge of a known volume of fluid from the output 60 of the apparatus 54 and result in the piston 42 displacing downwardly a known distance, thereby increasing the restriction to fluid flow through the corresponding valve 20. An increase in pressure on the line 38 will cause discharge of a known volume of fluid from the output 60 of the apparatus 56 and result in the piston 42 displacing upwardly a known distance, thereby decreasing the restriction to fluid flow through the corresponding valve 20.

Referring additionally now to FIGS. 3A–D, a fluid metering apparatus 66 embodying principles of the present invention is representatively illustrated, the apparatus being shown in a sequence of operation thereof. The apparatus 66 may be used for either or both of the apparatuses 54, 56 of the actuation systems 48, 50 described above. However, it is to be clearly understood that the apparatus 66 may be used in other actuation systems without departing from the principles of the present invention.

The apparatus 66 includes a hydraulic input port 68 and a hydraulic output port 70. As described in detail below, pressure applied to the input port 68 results in discharge of a known volume of fluid from the output port 70. A check valve 72 prevents fluid flow from the input 68 directly to the output 70, but permits fluid flow directly from the output to the input. When used with an actuator, such as the actuator 22 depicted in FIGS. 2A&B, the check valve 72 permits discharge of fluid from one of the chambers 44, 46 when fluid is introduced into the other chamber. Thus, when fluid is introduced into the chamber 44 from one of the apparatuses 54, 56, the piston 42 displaces downwardly and fluid is discharged from the chamber 46 through the check valve 72 of the other apparatus. Of course, if the apparatus 66 depicted in FIGS. 3A–D is used in another actuation system, the check valve 72 may not be necessary.

The apparatus 66 includes a housing assembly 74, a piston assembly 76, a valve assembly 78 and a latching device 80. The valve assembly 78 is substantially received within the piston assembly 76 and is displaceable therewith. Together, the piston assembly 76 and valve assembly 78 divide an internal bore 82 of the housing assembly 74 into two fluid chambers 84, 86.

Figure 3A:
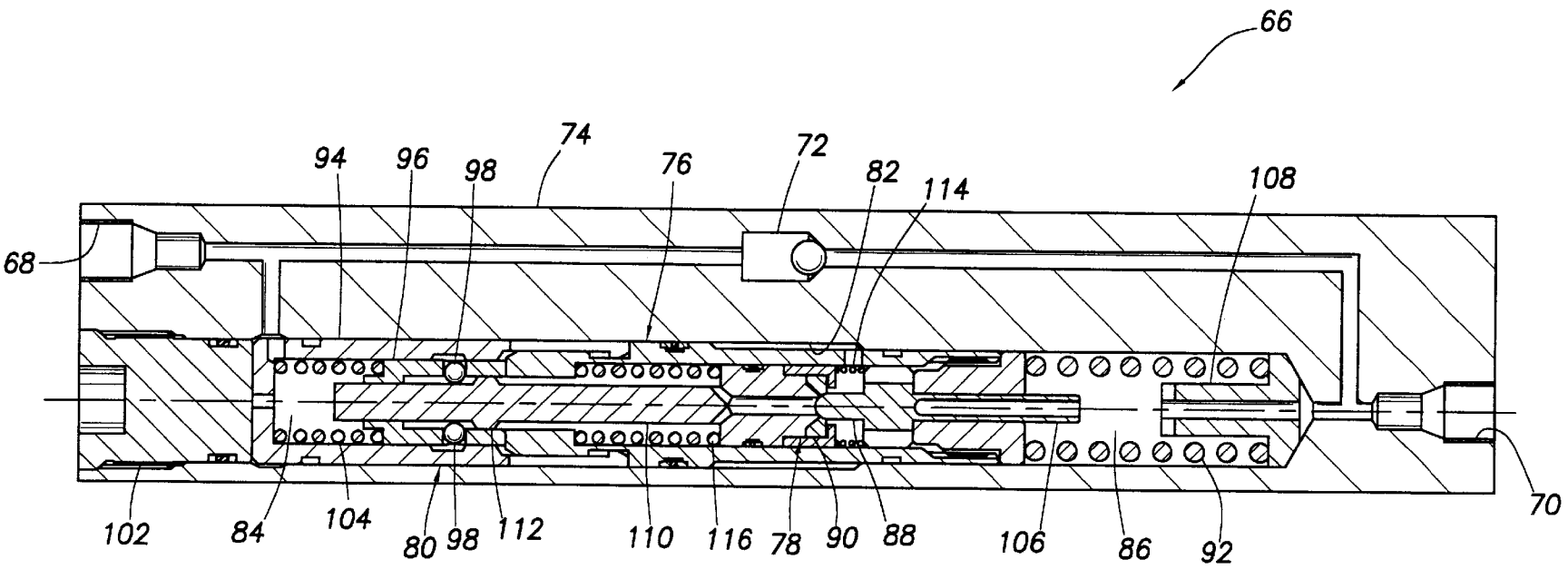
FIGS. 3A–D are cross-sectional views of a fluid metering apparatus usable in the actuation system of FIGS. 2A&B, the views showing a sequence of operation of the apparatus.

As depicted in FIG. 3A, the chamber 84 is in fluid communication with the input 68 and the chamber 86 is in fluid communication with the output 70. The valve assembly 78 is closed, a closure member 88 thereof sealingly engaging a seat go thereof and preventing fluid communication between the chambers 84, 86. It will be readily appreciated that, if the piston assembly 76 and valve assembly 78 are displaced to the right as viewed in FIG. 3A, fluid in the chamber 86 will be discharged from the output port 70 and fluid will be drawn into the chamber 84 from the input port 68.

To displace the piston assembly 76 and valve assembly 78 to the right, pressure is applied to the input port 68. A preloaded spring 92 biases the assemblies 76, 78 to the left, and so the force exerted by the spring 92 must be overcome by the pressure applied to the assemblies before the assemblies will displace to the right. Thus, one use of the spring 92 is to set a minimum actuation pressure which must be applied to the input port 68 for the assemblies 76, 78 to displace to the right and discharge fluid from the output port 70.

It will be readily appreciated by one skilled in the art that, if the piston assembly 76 and valve assembly 78 have different piston areas exposed to pressure in the chambers 84, 86, a differential pressure may be produced across the piston and valve assemblies when pressure is applied to the input port 68. For example, if a larger piston area on the piston and valve assemblies 76, 78 is exposed to the chamber 84 than is exposed to the chamber 86, then when pressure is applied to the input port 68, a greater pressure will be produced in the chamber 86 and thus in an actuator connected to the output port 70. Therefore, the apparatus 66 may also be used as a pressure multiplier (or pressure divider) by providing suitable piston areas on the piston and valve assemblies 76, 78. The use of the apparatus 66 as a pressure multiplier may be especially advantageous where the associated actuator requires an elevated pressure for its operation, where a piston of the actuator has become stuck, etc.

Figure 3B:
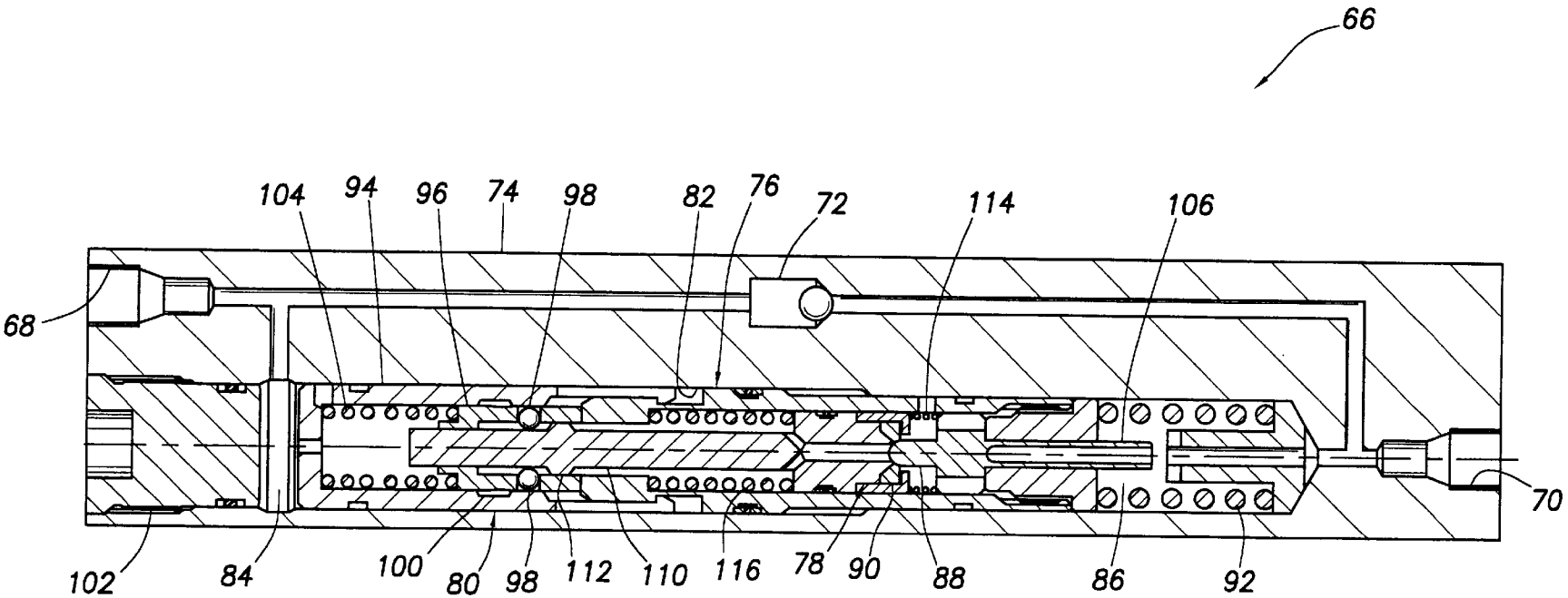

In FIG. 3B the apparatus 66 is depicted after sufficient pressure has been applied to the input port 68 to begin displacing the assemblies 76, 78 to the right. In this view it may be readily seen that the volume of the chamber 86 is decreasing, and the volume of the chamber 84 is increasing, as the assemblies 76, 78 displace to the right. Accordingly, fluid is being discharged from the chamber 86 to the output port 70, and fluid is being drawn into the chamber 84 from the input port 68.

In addition, an outer ball release sleeve 94 of the latching device 80 has displaced to the left relative to the piston assembly 76 as the piston assembly has displaced to the right. Note that in FIG. 3A, the sleeve 94 was positioned relative to a ball cage 96, so that multiple balls 98 received in openings of the cage could be outwardly displaced into an annular recess 100 formed internally on the sleeve 94. However, note that in FIG. 3B, after rightward displacement of the piston assembly 76, the balls 98 are no longer aligned with the recess 100, and so are inwardly retained by the sleeve 94.

When the latching device 80 is in the configuration depicted in FIG. 3A, the sleeve 94 contacts a plug 102 installed at one end of the bore 82. The plug 102 serves as an abutment which the sleeve 94 engages when the piston assembly 76 displaces to the left as described below. Further leftward displacement of the piston assembly 76 after the sleeve 94 has engaged the plug 102 compresses a spring 104 which biases the sleeve 94 to the left relative to the piston assembly. Thus, displacement of the piston assembly 76 and the valve assembly 78 to the right as viewed in FIG. 3B results in the sleeve 94 displacing to the left relative to the piston assembly, and results in the sleeve inwardly retaining the balls 98.

Figure 3C:
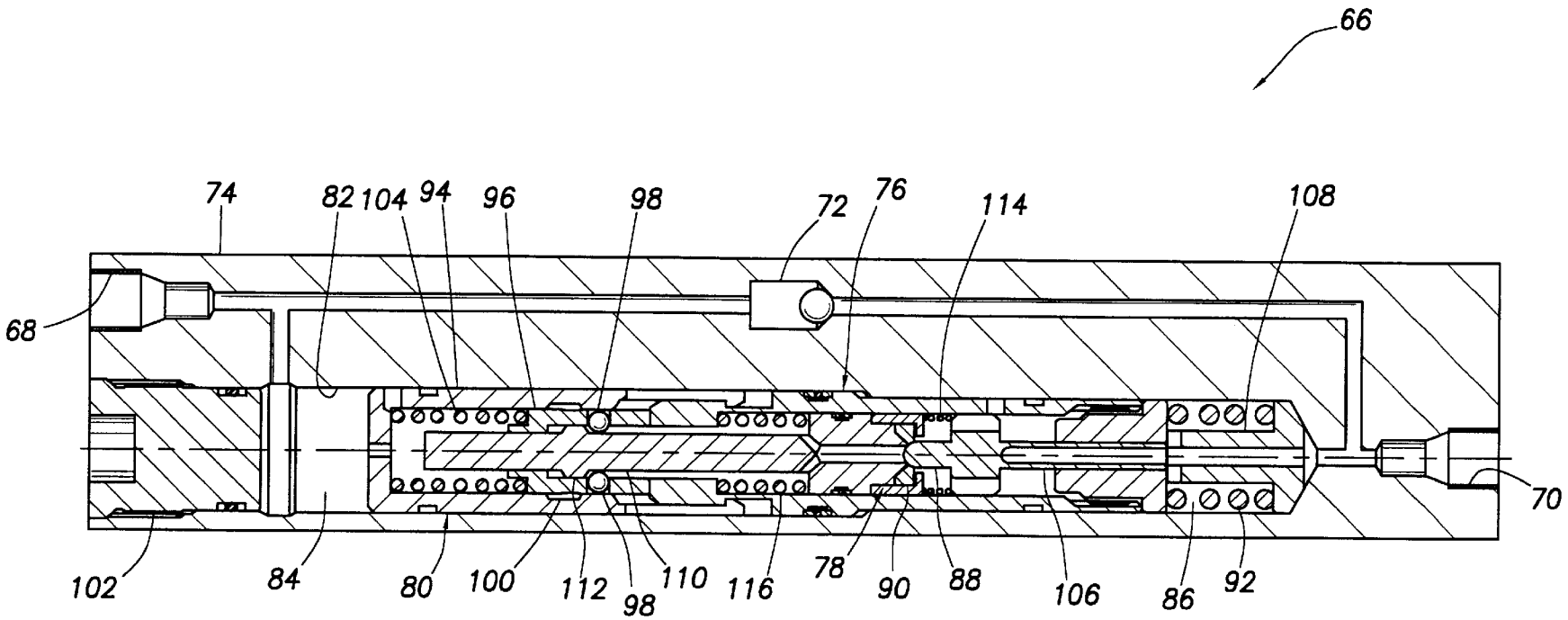

In FIG. 3C, the apparatus 66 is depicted in a configuration in which the piston assembly 76 and valve assembly 78 are fully displaced to the right. A rightwardly extending prong 106 has engaged a stop member 108, thereby preventing further rightward displacement of the valve assembly 78. The piston assembly 76, however, has continued to displace to the right after rightward displacement of the valve assembly 78 was prevented by the stop member 108, until the piston assembly also engaged the stop member. Thus, the stop member 108 serves as an abutment to engage and prevent further rightward displacement of the piston assembly 76 and the valve assembly 78, but the rightward displacement of the valve assembly is stopped before the rightward displacement of the piston assembly, resulting in some leftward displacement of the valve assembly relative to the piston assembly.

Note that an elongated stem 110 of the valve assembly 78 is sealingly received in the piston assembly 76 and extends leftward from the seat go. A radially enlarged portion 112 formed externally on the stem 110 is positioned to the left of the balls 98 as depicted in FIG. 3C, but was previously positioned to the right of the balls as depicted in FIGS. 3A&B. Such displacement of the stem portion 112 relative to the balls 98 results from the leftward displacement of the valve assembly 78 relative to the piston assembly 76, due to engagement of the assemblies with the stop member 108 as described above.

When the prong 106 initially engages the stop member 108, the valve assembly 78 ceases its rightward displacement and the balls 98 contact the stem portion 112. This engagement between the balls 98 and the stem portion 112 momentarily ceases rightward displacement of the cage 96 as the piston assembly 76 continues to displace to the right. Eventually, the balls 98 are aligned with the recess 100 and are permitted to displace radially outward, and the rightwardly biasing force of the spring 104 exerted on the cage 96 then displaces the cage to the right, until it is positioned relative to the stem portion 112 as shown in FIG. 3C, with the balls 98 positioned to the right of the stem portion and the balls again inwardly retained by the sleeve 94.

With the apparatus 66 in the configuration as depicted in FIG. 3C, the known volume of fluid has been discharged from the chamber 86 to the output port 70. This discharge of the known volume of fluid may be used to incrementally advance a piston of an actuator operatively connected to a well tool, such as the piston 42 of the actuator 22 used to actuate the well tool 20 described above. Of course, the discharge of the known volume of fluid may be used for other purposes, without departing from the principles of the present invention.

Figure 3D:
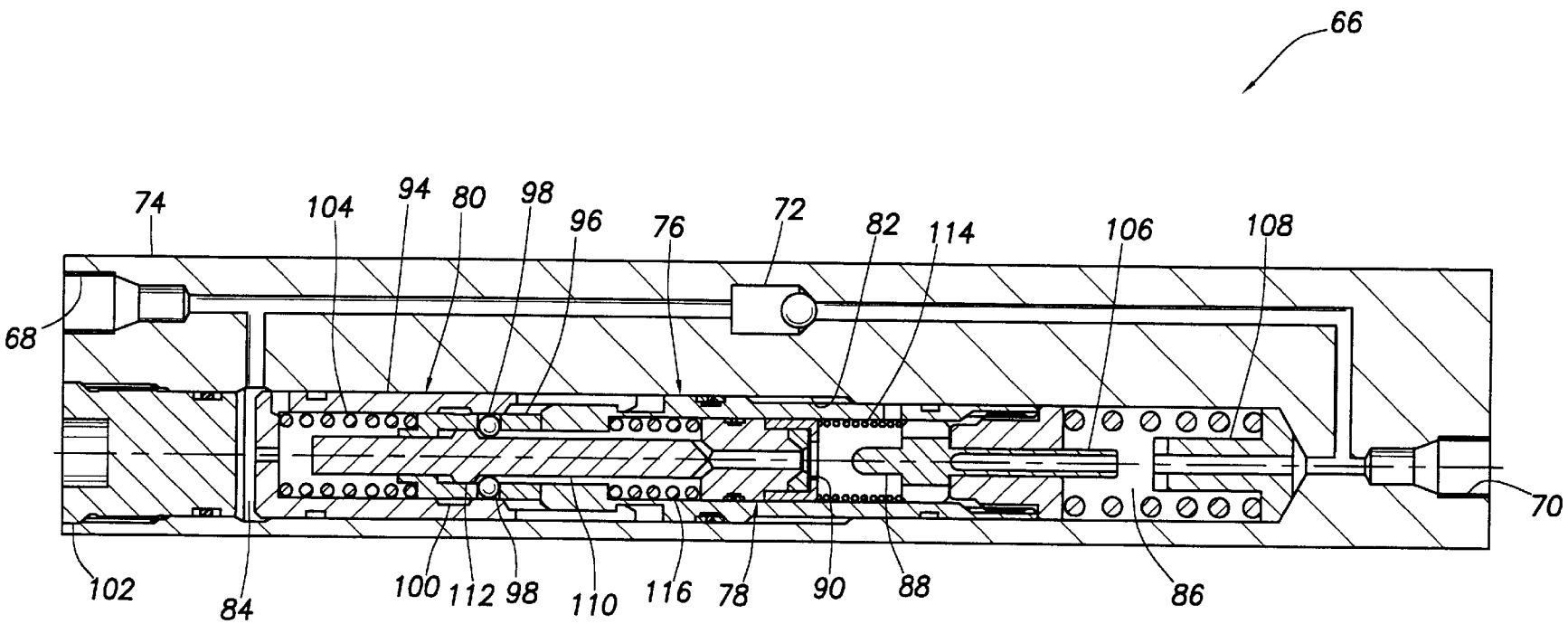

After the known volume of fluid has been discharged from the apparatus 66, pressure on the input port 68 is relieved, or otherwise decreased, thereby permitting the spring 92 to displace the piston assembly 76 and valve assembly 78 to the left as viewed in FIG. 3D. Note that, with the balls 98 positioned to the right of the stem portion 112, the latching device 80 prevents the stem 110 from displacing relative to the piston assembly 76 as the piston assembly displaces to the left. The closure member 88, however, is biased to the right by a spring 114 and disengages from the seat go as the piston assembly 76 displaces to the left.

It will be readily appreciated that, as the piston assembly displaces to the left with the closure member 88 disengaged from the seat go, the valve assembly 78 is open, and is secured in this configuration by the latching device 80. At this point, fluid communication is permitted between the chambers 84, 86, so that fluid is not discharged from the chamber 84 to the input port 68 and fluid is not drawn into the chamber 86 from the output port 70 as the piston assembly 76 displaces to the left. Instead, fluid is merely transferred from the chamber 84 to the chamber 86 through the open valve assembly 78.

As the piston assembly 76 displaces to the left, the sleeve 94 eventually engages the plug 102, ceasing further leftward displacement of the sleeve. The balls 98 become aligned with the recess 100 and are permitted to outwardly displace. A spring 116 biases the stem 110 to the right, so that, when the balls 98 become aligned with the recess 100, the stem 110 displaces to the right relative to the piston assembly 76.

This rightward displacement of the stem 110 causes the seat go to engage the closure member 88, thereby closing the valve assembly 78. At this point, the apparatus 66 returns to the configuration as depicted in FIG. 3A. Note that, with the stem portion 112 again positioned to the right of the balls 98, the valve assembly 78 is secured in its closed configuration so that, if an increased pressure is again applied to the input port 68, the valve assembly will displace with the piston assembly 76 while preventing fluid communication between the chambers 84, 86.

Thus, a sequence of operation of the apparatus 66 is as follows: 1) with the apparatus in the configuration depicted in FIG. 3A, pressure is applied to the input port 68, thereby displacing the piston assembly 76 and valve assembly 78 to the right, and discharging the known volume of fluid from the chamber 86 to the output port 70 as depicted in FIG. 3B; 2) at the end of the rightward displacement of the assemblies 76, 78, the prong 106 engages the stop member 108, causing the balls 98 to be repositioned to the right of the stem portion 112 as depicted in FIG. 3C; 3) pressure at the input port 68 is decreased, permitting the piston assembly 76 and valve assembly 78 to displace to the left, the valve assembly opening as the piston assembly displaces leftward as depicted in FIG. 3D; and 4) the latching device 80 engages the plug 102, thereby permitting the balls 98 to be repositioned to the left of the stem portion 112 and closing the valve assembly 78.

Figure 4A:
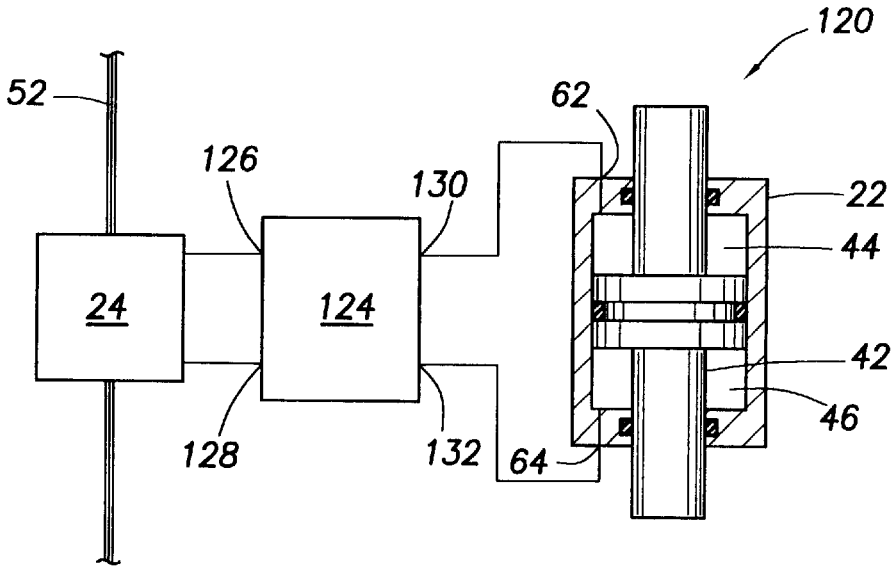
FIGS. 4A&B are schematic views of a second hydraulically operated well tool actuation system usable in the method of FIG. 1.
Figure 4B:
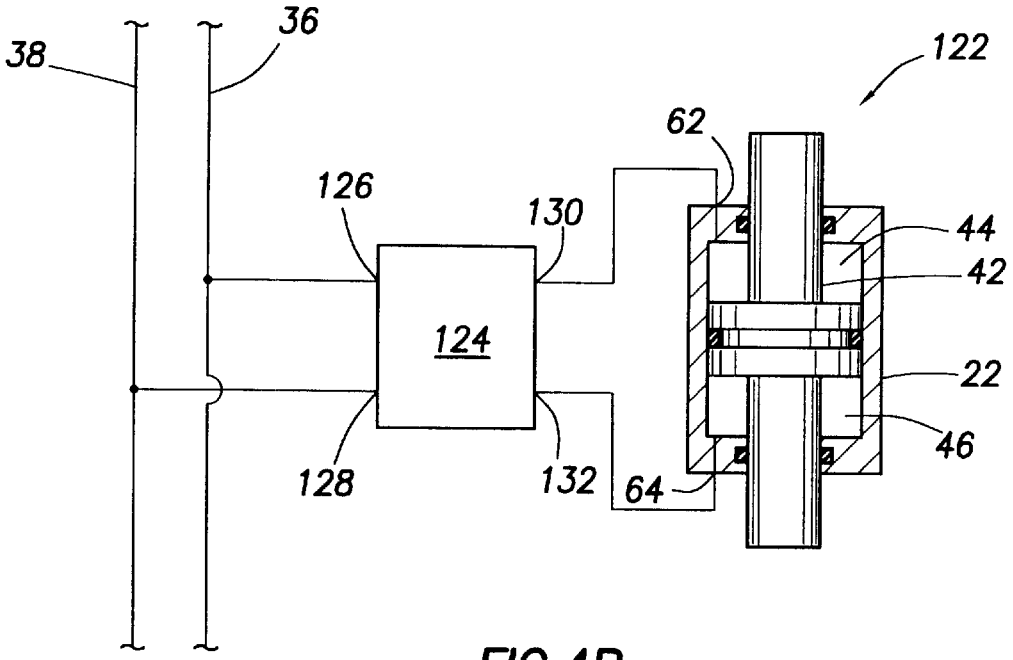

Referring additionally now to FIGS. 4A&B, alternate configurations of hydraulically operated well tool actuation systems 120, 122 usable in the method 10 and embodying principles of the present invention are representatively and schematically illustrated. Of course, the systems 120, 122 may be used in other methods without departing from the principles of the present invention. The system 120 is representative of a situation in which multiple well tool assemblies (such as the tool assemblies 12, 14, 16, 18) are used in a well and the actuation control module 24 of each is capable of determining when the corresponding valve 20 has been selected for actuation thereof. The system 122 is representative of a situation in which one or more well tool assemblies are used in a well without the capability of independently selecting a corresponding valve for actuation thereof.

The actuation systems 120, 122 are similar in many respects to the actuation systems 48, 50 described above. However, instead of the pair of fluid metering apparatuses 54, 56 used in the actuation systems 48, 50, the actuation systems 120, 122 utilize only a single fluid metering apparatus 124. The fluid metering apparatus 124 includes two hydraulic input ports 126, 128 and two output ports 130, 132.

It will be readily appreciated that actuation systems such as the systems 120, 122 could be constructed by merely combining the two apparatuses 54, 56 of the systems 48, 50 into a single device. This is, of course, possible to achieve, but it is to be clearly understood that the apparatus 124 of the actuation systems 120, 122 is not necessarily a combination of separate apparatuses, which will be further appreciated upon consideration of the description hereinbelow of a specific fluid metering apparatus usable in the systems 120, 122.

The function of the control module 24 is described above, and will not be described further here in relation to the system 120, except to note that fluid communication is provided between one or more hydraulic lines of the lines 52 and the inputs ports 126, 128 when the control module detects that the corresponding valve 20 has been selected for actuation thereof. In contrast, in the system 122, fluid communication between the line 36 and the input port 126, and between the hydraulic line 38 and the input port 128 is maintained without the need to select the corresponding valve 20 for actuation thereof.

To discharge a known volume of fluid from the output port 130 of the apparatus 124 to the input port 62 of the actuator 22, pressure is applied to the input port 128 to displace the known volume of fluid from the input port into an internal chamber of the apparatus 124. The pressure on the input port 128 is then relieved and pressure is applied to the input port 126 to discharge the known volume of fluid from the chamber to the output port 130. Since the output port 130 is connected to the input port 62 of the actuator 22, the known volume of fluid enters the chamber 44 of the actuator and causes the piston 42 to displace downwardly, thereby increasing the restriction to fluid flow through the corresponding valve 20. This sequence of alternating pressure applications to the input ports 126, 128 may be repeated as desired to displace the piston 42 downward a desired total distance and produce a desired final restriction to fluid flow through the valve 20.

To displace the piston 42 upwardly, the apparatus 124 does not use one or more discharges of the known volume of fluid, but instead permits the piston to be fully upwardly displaced in one operation. To accomplish this result, pressure is applied to the input port 126 and, while the pressure remains applied to that input port, a greater pressure is applied to the other input port 128. The pressure applied to the input port 128 is communicated directly to the output port 132 and is transmitted to the input port 64 of the actuator 22, thereby causing the piston 42 to displace fully upwardly and reducing the restriction to fluid flow through the corresponding valve 20.

Figure 5A:
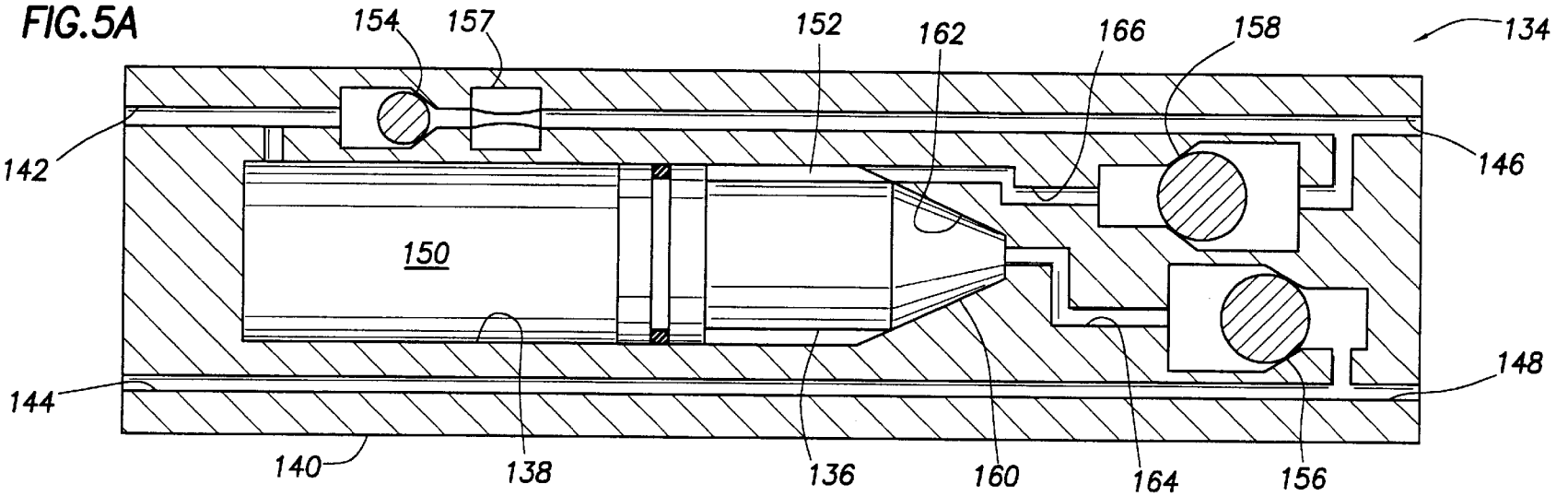
FIGS. 5A–C are schematic cross-sectional views of a fluid metering apparatus usable in the actuation system of FIGS. 4A&B, the views showing a sequence of operation of the apparatus.
Figure 5B:
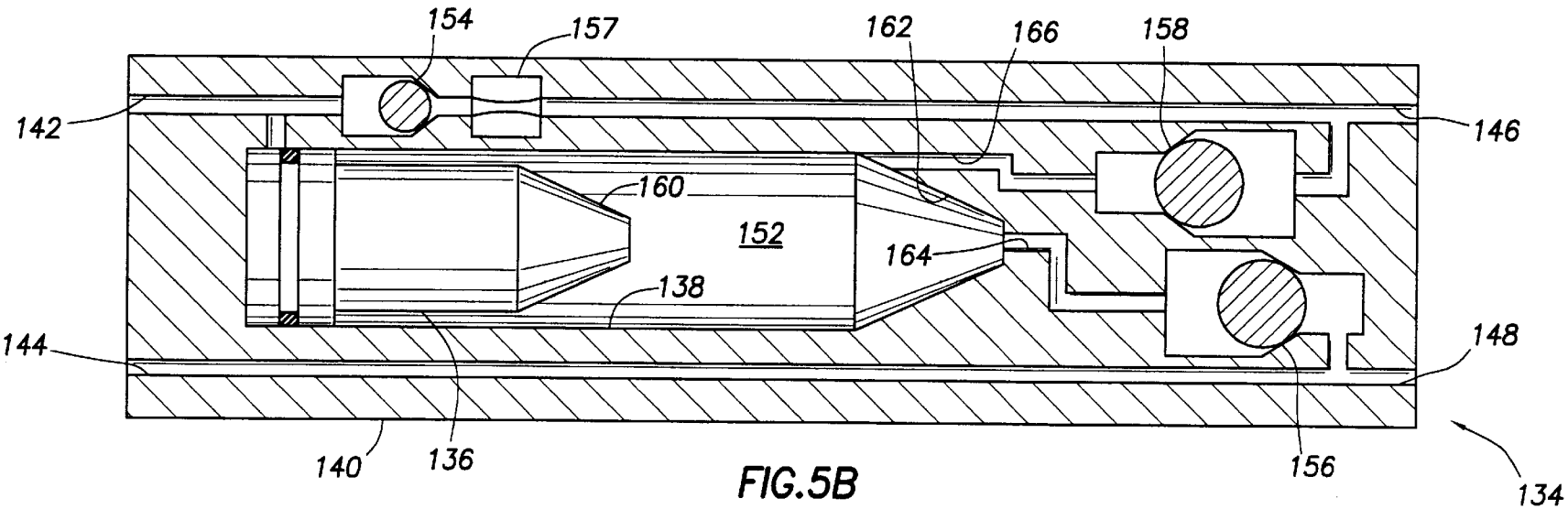
Figure 5C:
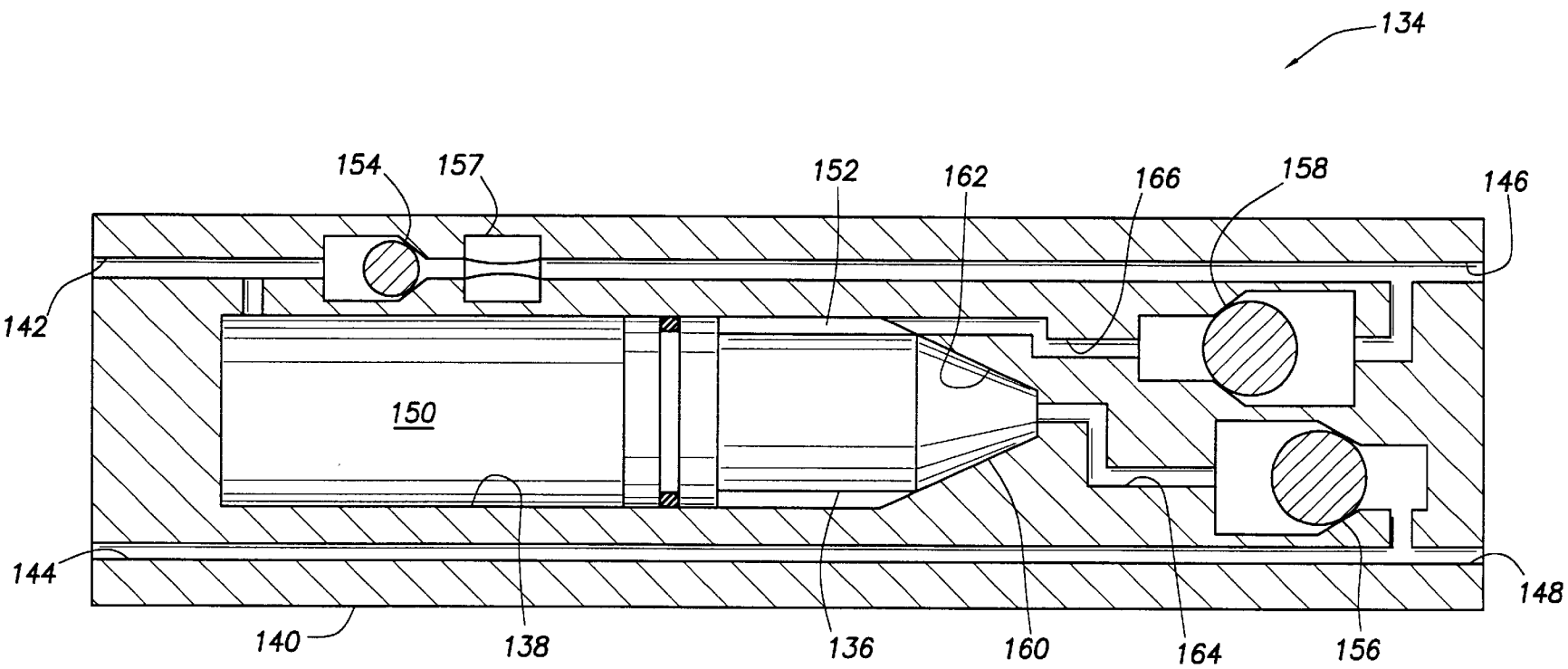
Figure 6A:
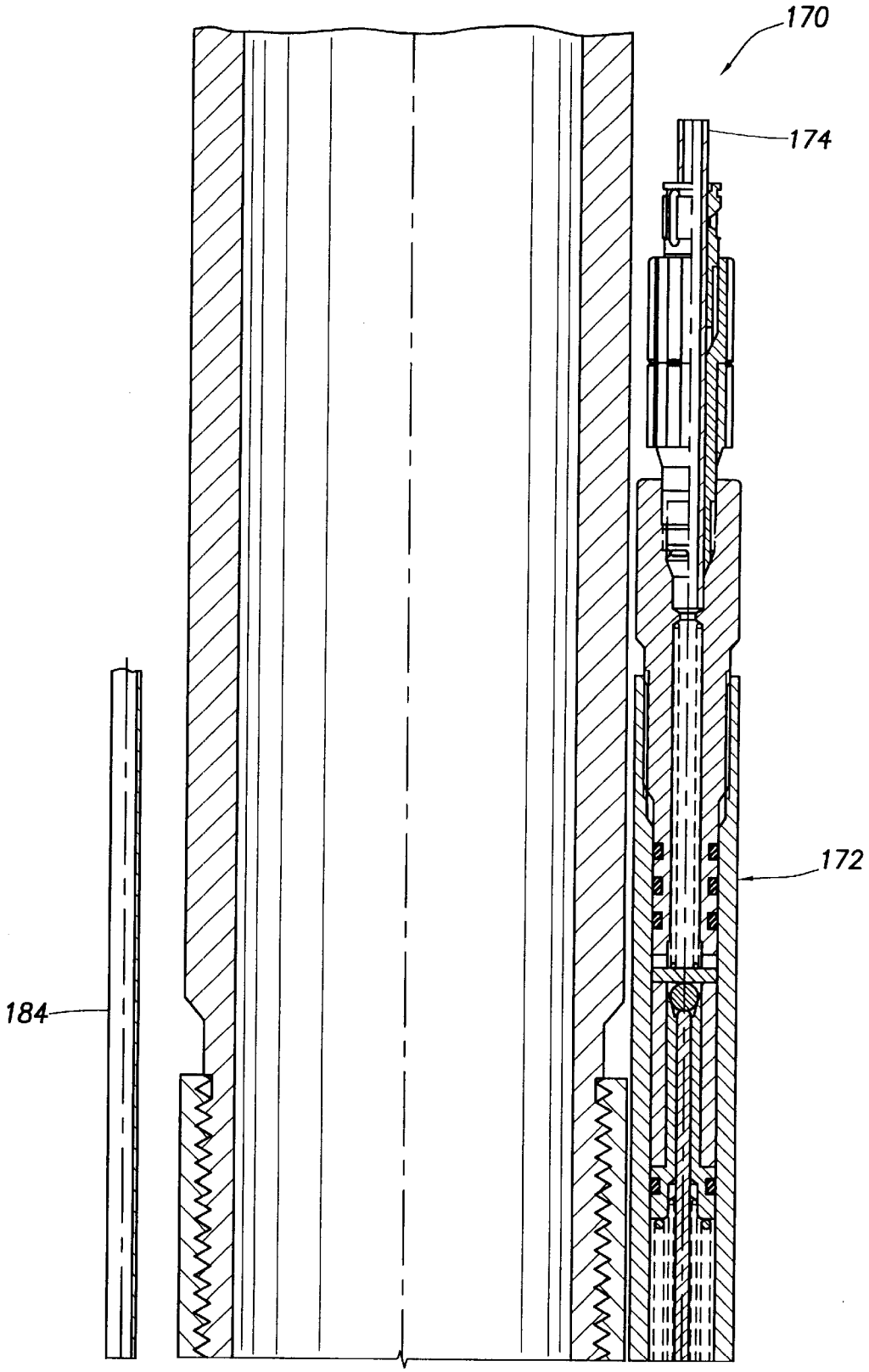
FIGS. 6A–D are cross-sectional views of a third hydraulically operated well tool actuation system usable in the method of FIG. 1.
Figure 6B:
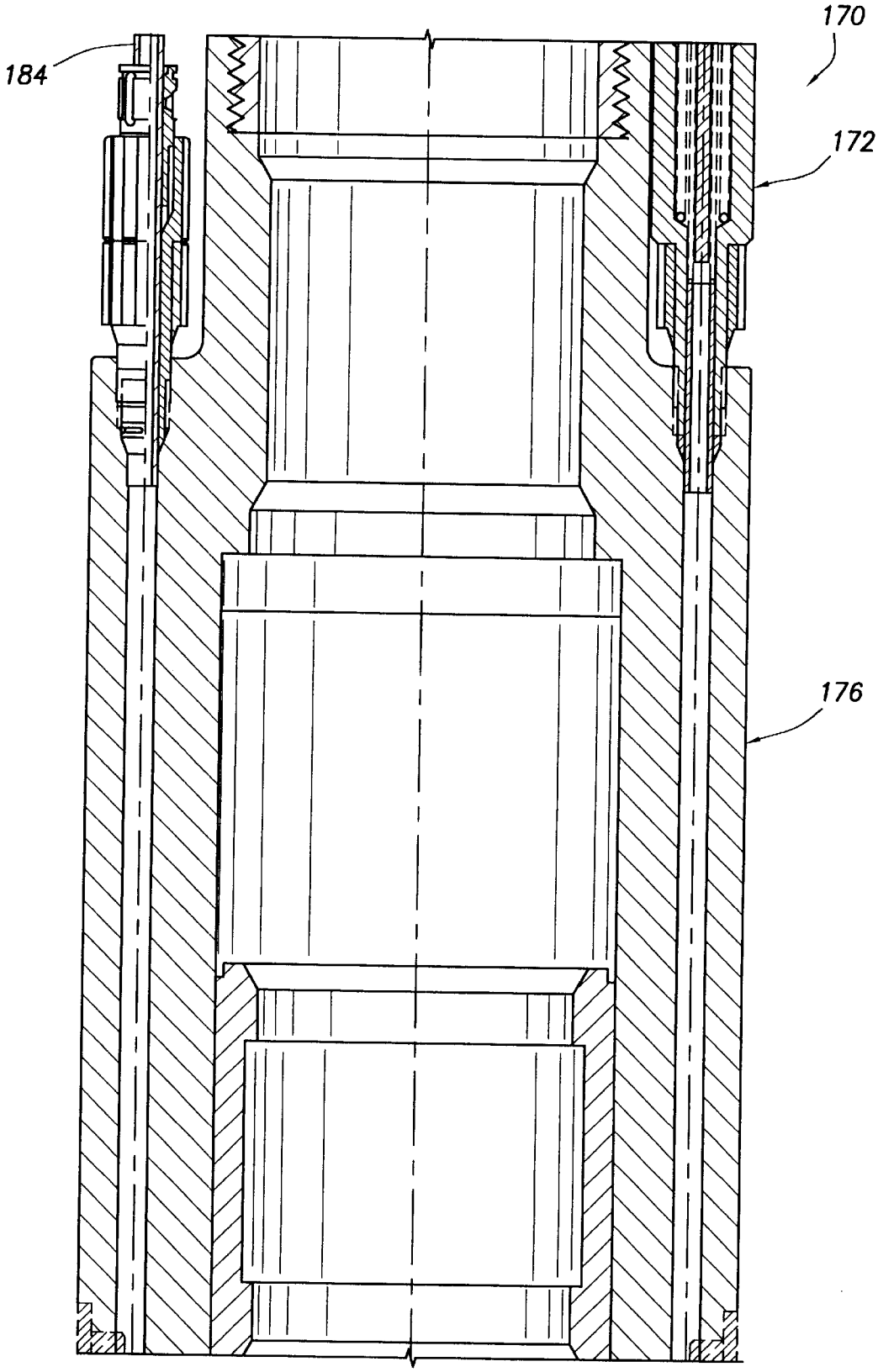
Figure 6C:
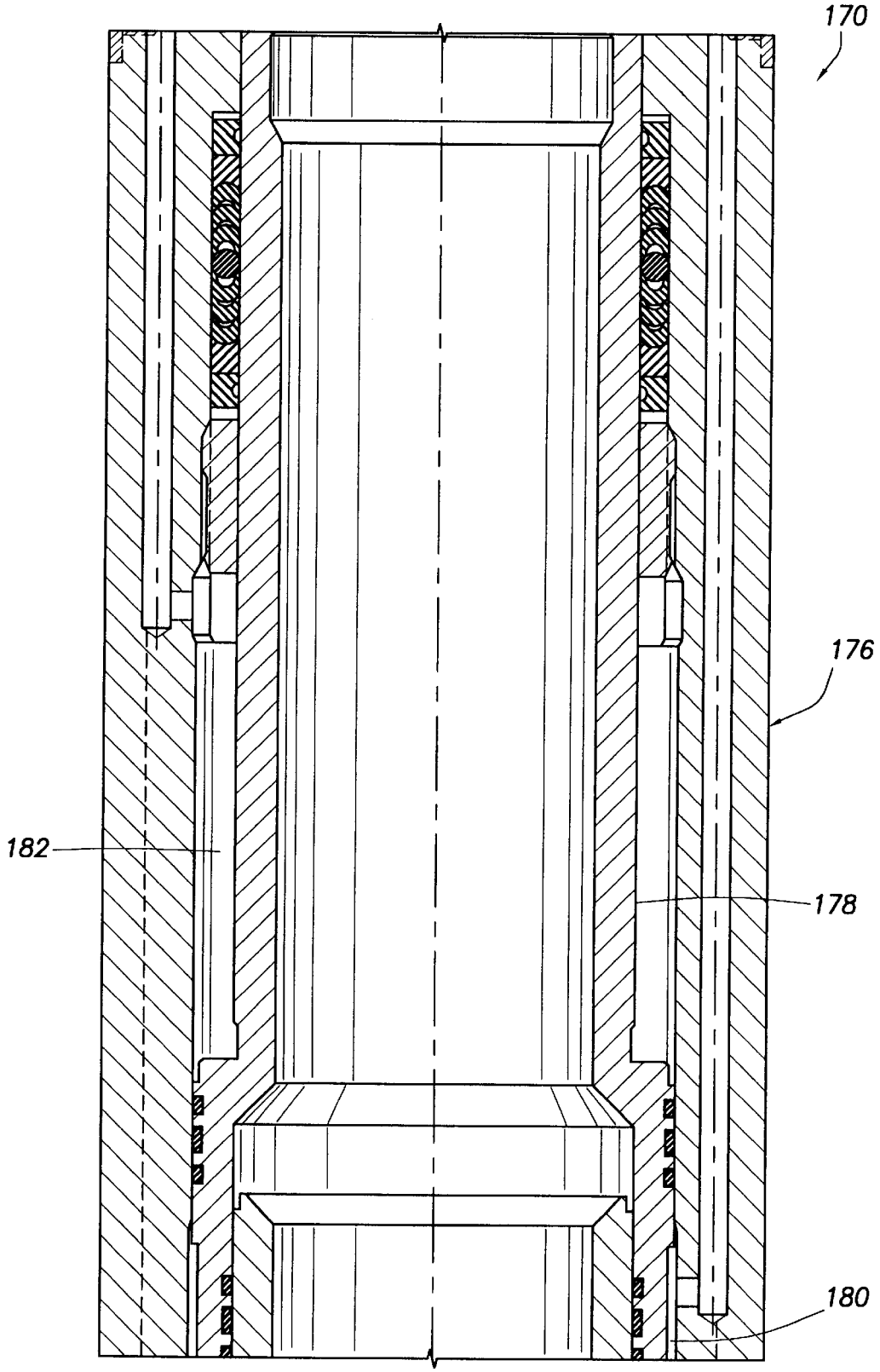
Figure 6D:
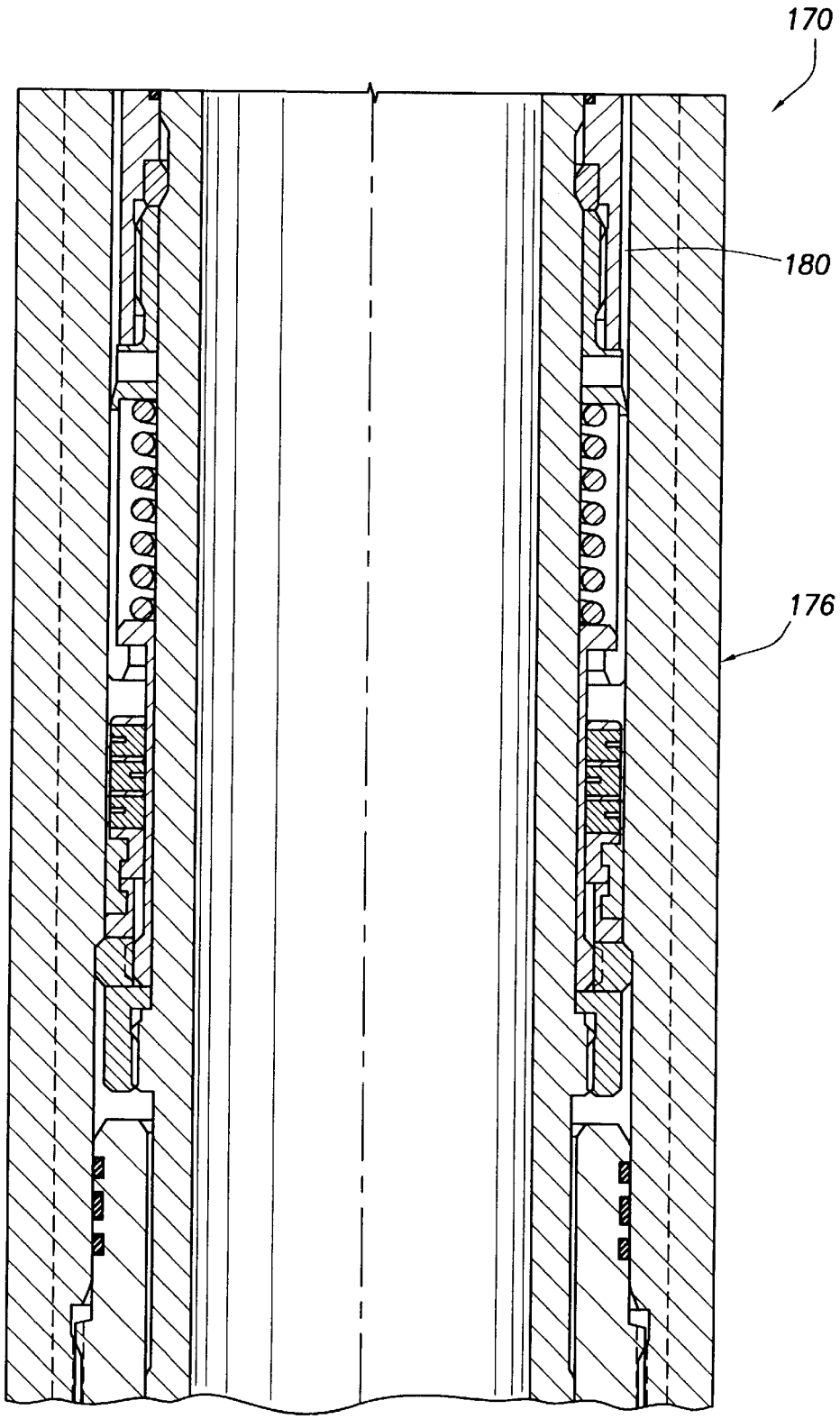

Referring additionally now to FIGS. 5A–C, a fluid metering apparatus 134 embodying principles of the present invention is representatively and schematically illustrated. The fluid metering apparatus 134 may be used for the apparatus 124 in the actuation systems 120, 122 described above. However, it is to be clearly understood that the apparatus 134 may also be used in other actuation systems, and in other types of systems, without departing from the principles of the present invention.

The apparatus 134 includes a piston 136 reciprocably and sealingly received within a bore 138 formed in a housing 140. The piston 136 divides the bore 138 into two chambers 150, 152. Two hydraulic input ports 142, 144 and two hydraulic output ports 146, 148 are provided in the housing 140.

The input port 142 is in fluid communication with the output port 146, but a check valve 154 prevents direct fluid flow from the input port to the output port. A restrictor 157 substantially restricts fluid flow from the output port 146 to the input port 142, for a purpose that is described below. The input port 142 is in direct fluid communication with the chamber 150.

The input port 144 is in direct fluid communication with the output port 148. In addition, both the input and output ports 144, 148 may be placed in fluid communication with the chamber 152 via a check valve 156. Another check valve 158 permits fluid flow from the chamber 152 to the output port 146.

A closure member 160 extends rightwardly on the piston 136 and is sealingly engageable with a seat 162 formed internally in the housing 140. When the closure member 160 is sealingly engaged with the seat 162, a passage 164 interconnecting the chamber 152 and the check valve 156 is isolated from a passage 166 interconnecting the chamber 152 and the check valve 158. This sealing engagement effectively divides the chamber 152 into two portions —one in fluid communication with the check valve 156, and the other in fluid communication with the check valve 158.

As depicted in FIG. 5A, no pressure has been applied to either of the input ports 142, 144. In FIG. 5B, it may be seen that pressure has been applied to the input port 144 to displace a known volume of fluid from the input port, through the check valve 156, and into the chamber 152, thereby displacing the piston 136 to the left. Note that leftward displacement of the piston 136 discharges fluid from the chamber 150 to the input port 142.

Note, also, that the check valve 158 permits pressure applied to the chamber 152 during this step to also be transmitted to the output port 146. Thus, an actuator connected to the output ports 148, 146 remains pressure balanced during this step. The restrictor 157 prevents any significant displacement of a piston of an actuator connected to the output ports 146, 148 while pressure is being applied to the input port 144.

Once the piston 136 has been fully leftwardly displaced, pressure is applied to the input port 142. In FIG. 5C, it may be seen that the pressure applied to the input port 142 causes the piston 136 to displace back to the right, thereby discharging the known volume of fluid from the chamber 152, through the check valve 158 and to the output port 146. The check valve 154 prevents the pressure applied to the input port 142 from being transmitted directly to the output port 146.

Once the known volume of fluid has been discharged from the output port 146, the pressure on the input port 142 may be relieved. It will be readily appreciated that the apparatus 134 is now in the same configuration as it was initially, as depicted in FIG. 3A, and that the above sequence of steps may be repeated to discharge another known volume of fluid from the output port 146. Thus, alternating applications of fluid pressure to the input ports 142, 144 may be utilized to discharge any number of known volumes of fluid from the output port 146.

If it is desired to discharge fluid from the other output port 148, then, with the apparatus 134 in the configuration shown in FIGS. 5A&C, pressure is applied to the input port 142 to sealingly engage the closure member 160 with the seat 162. Note that the diameter at which the closure member 160 sealingly engages the seat 162 is smaller than the diameter at which the piston 136 sealingly engages the bore 138.

Pressure is then applied to the input port 144, which pressure is greater than the pressure applied to the input port 142. Since the sealing diameter between the closure member 160 and the seat 162 is less than the sealing diameter between the piston 136 and the bore 138, the greater pressure applied to the input port 144 does not cause the piston 136 to displace to the left. Instead, the closure member 160 remains sealingly engaged with the seat 162.

Of course, if the pressure applied to the input port 144 is more than a predetermined amount greater than the pressure applied to the input port 142, the piston 136 will displace to the left and sealing engagement between the closure member 160 and the seat 162 will be eliminated. The predetermined amount of pressure is determined by the relative sealing areas of the piston 136 exposed to the pressures at the input ports 142, 144 and will depend upon the specific dimensions and pressures utilized in a particular situation.

The pressure applied to the input port 144 is transmitted directly to the output port 148. Fluid is received in the output port 146 from an actuator when fluid is discharged from the output port 148, due to displacement of a piston of the actuator. This received fluid flows from the output port 146 to the input port 142 via the check valve 154. Thus, pressure applied to the input port 144, while a lesser pressure on the input port 142 maintains the closure member 160 in sealing engagement with the seat 162, is transmitted with any desired volume of fluid to the actuator via the output port 148.

A sequence of operation of the apparatus 134 is as follows: 1) pressure is applied to the input port 144 when the apparatus is in the configuration as depicted in FIG. 5A; 2) the pressure applied to the input port 144 causes a known volume of fluid to be introduced into the chamber 152 as depicted in FIG. 5B; 3) the pressure on the input port 144 is relieved and pressure is applied to the input port 142 to displace the piston 136 to the right and discharge the known volume of fluid from the chamber 152 to the output port 146 as depicted in FIG. 5C; and 4) to discharge fluid from the output port 148, pressure is applied to the input port 142 to sealingly engage the closure member 160 with the seat 162, and then a greater pressure is applied to the input port 144.

Referring additionally now to FIGS. 6A–D, another well tool actuation system 170 embodying principles of the present invention is representatively illustrated. The actuation system 170 includes a fluid metering apparatus 172 interconnected between an actuator 176 and a hydraulic line 174 extending to a remote location. The actuator 176 is that of the Interval Control Valve (not shown) commercially available from Halliburton Energy Services, Inc. and referred to above.

The fluid metering apparatus 172 is used in the system 170 to transfer a known volume of fluid from the hydraulic line 174 to the actuator 176, in order to produce a known incremental displacement of a piston 178 of the actuator. Specifically, when the known volume of fluid is discharged from the apparatus 172 to a lower chamber 180 of the actuator 176, the piston 178 displaces upward a known distance, thereby incrementally increasing a rate of fluid flow through the Interval Control Valve in a manner well known to those skilled in the art.

An upper chamber 182 of the actuator 176 is on an opposite side of the piston 178 from the lower chamber 180. When the piston 178 displaces upward, fluid in the upper chamber 182 is displaced into another hydraulic line 184 in fluid communication therewith. Conversely, fluid may also be transferred from the hydraulic line 184 into the chamber 182 to downwardly displace the piston 178 and thereby decrease a rate of fluid flow through the Interval Control Valve, or to completely close the Interval Control Valve to fluid flow therethrough. Downward displacement of the piston 178 furthermore results in fluid being transferred from the lower chamber 180, through the apparatus 172, and into the hydraulic line 174, in a manner described more fully below.

To upwardly displace the piston 178, pressure is applied to the hydraulic line 174, which causes the known volume of fluid to be discharged from the apparatus 172 and into the lower chamber 180. To produce a desired total upward displacement of the piston 178, this operation may be repeated. To downwardly displace the piston 178, pressure is applied to the hydraulic line 184. The operation of the apparatus 172 is described more fully below in relation to FIGS. 7A–C, 8A–C, 9A–C and 10A–C, in which a sequence of operation of the apparatus 172 is depicted.

Figure 7A:
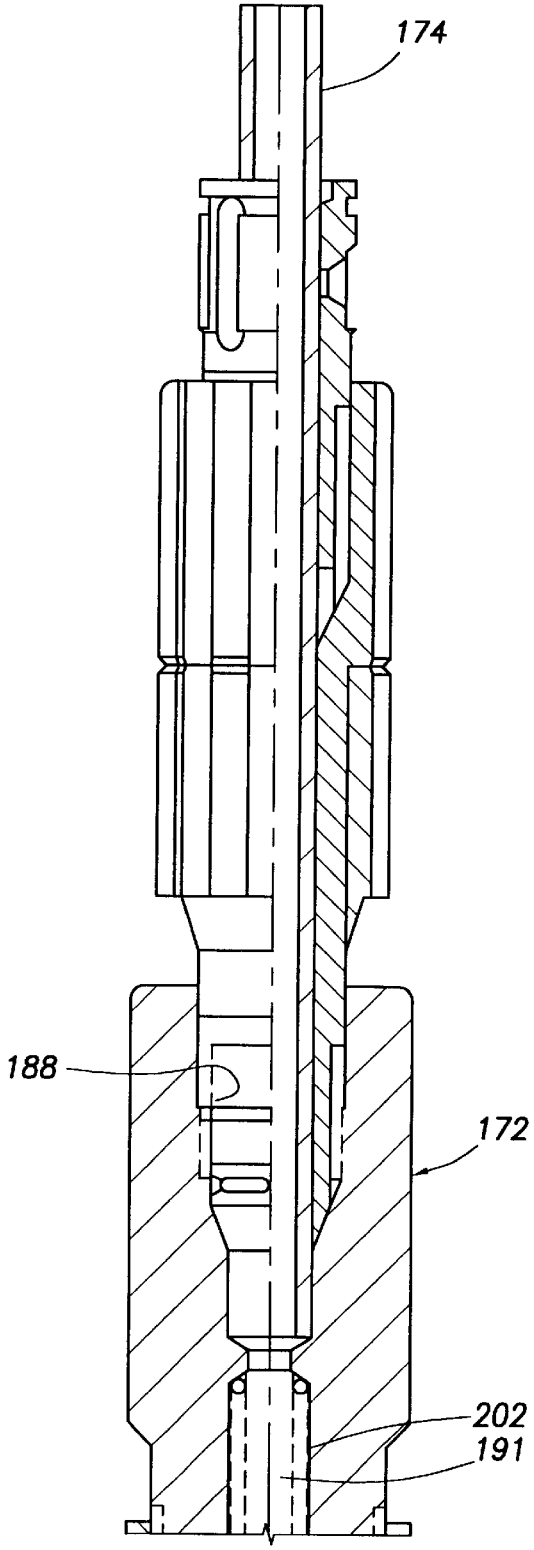
FIGS. 7A–C are enlarged cross-sectional views of a fluid metering apparatus of the actuation system of FIGS. 6A–D, the apparatus being shown in an initial configuration.
Figure 7B:
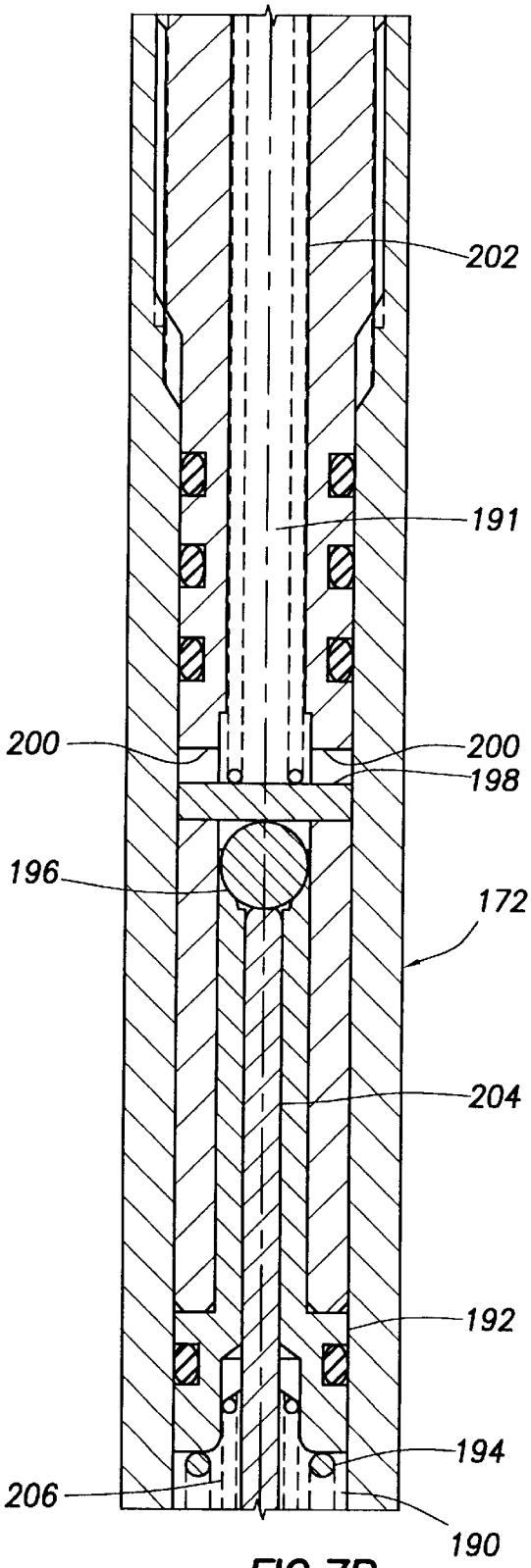
Figure 7C:
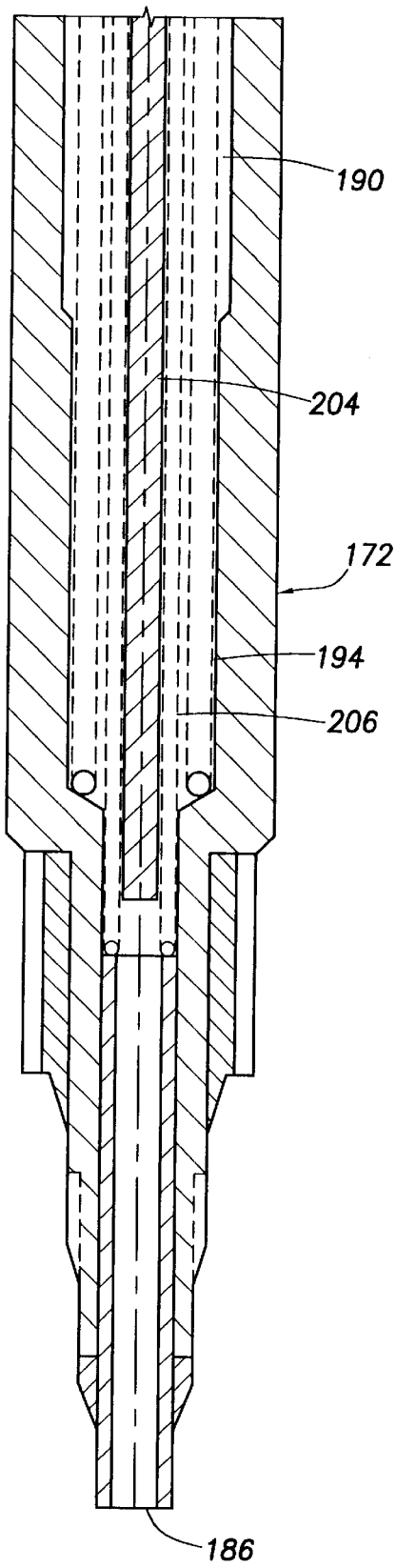

Referring additionally now to FIGS. 7A–C, the apparatus 172 is representatively illustrated apart from the remainder of the actuation system 170. The apparatus 172 is depicted in a configuration in which it is initially available for use to discharge a known volume of fluid from an output port 186 thereof. The known volume of fluid is initially contained in a chamber 190 below a piston 192 sealingly and reciprocably received within the apparatus 172. Another known volume of fluid is received into the apparatus 172 from the hydraulic line 174 via an input port 188 when the initial known volume of fluid is discharged from the apparatus.

To discharge the known volume of fluid from the chamber 190 through the output port 186, pressure is applied to the input port 188. This pressure displaces the piston 192 downward against an upwardly biasing force exerted by a spring 194. As the piston 192 displaces downward, the known volume of fluid in the chamber 190 is displaced out of the output port 186, and another known volume of fluid is drawn into a chamber 191 above the piston from the input port 188.

A check valve 196 displaces with the piston 192. As depicted in FIG. 7B, the check valve 196 is closed. A pin 198 received in longitudinally extending slots 200 is biased downward by a spring 202 and maintains the check valve 196 in its closed configuration as viewed in FIG. 7B. However, note that when the piston 192 displaces downward, the spring 202 and pin 198 will no longer maintain the check valve 196 closed. Note, also, that fluid flow is permitted through the check valve 196 in an upward direction as viewed in FIG. 7B, when the downwardly biasing force of the spring 202 is overcome by a pressure differential from the chamber 190 to the chamber 191, and it will thus be readily appreciated that the check valve permits fluid flow from the output port 186 to the input port 188 through the apparatus 172.

A rod 204 is reciprocably received in the piston 192. The rod 204 is biased upwardly by a spring 206. The spring 206 does not exert sufficient force to open the check valve 196 against the downwardly biasing force of the spring 202. However, when the piston 192 has displaced downwardly and the spring 202 no longer biases the check valve 196 closed, only a pressure differential across the check valve will maintain it closed against the biasing force of the spring 206 exerted via the rod 204.

Figure 8A:
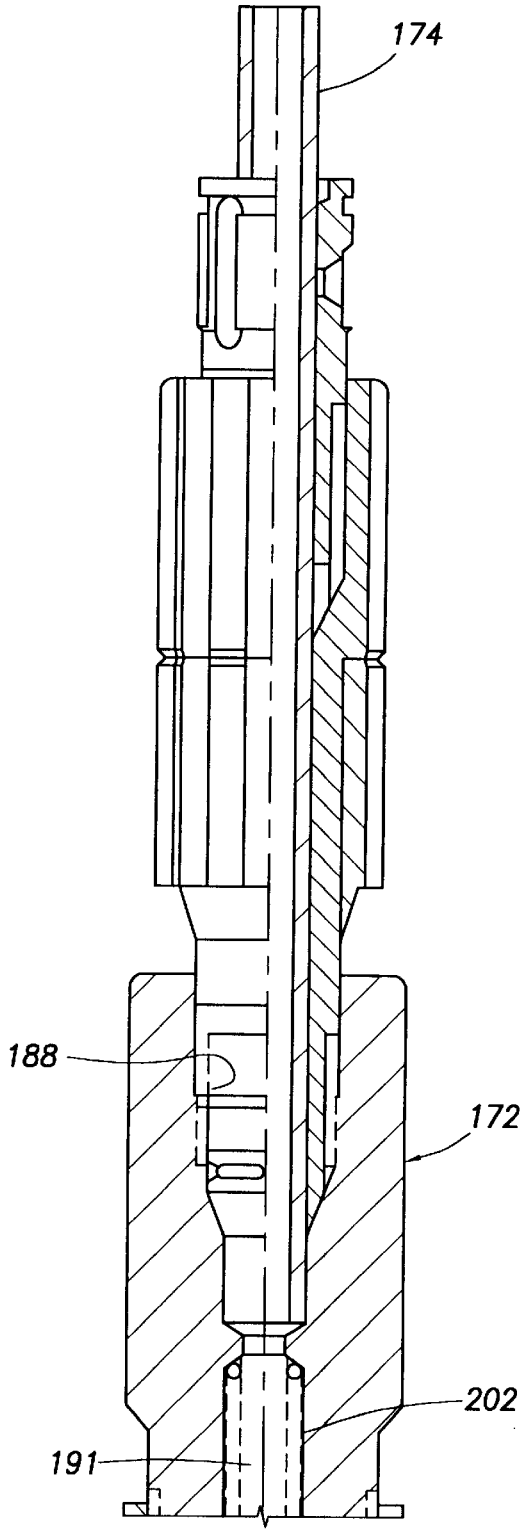
FIGS. 8A–C are enlarged cross-sectional views of the fluid metering apparatus of the actuation system of FIGS. 6A–D, the apparatus being shown in a configuration in which a known volume of fluid has been displaced from the apparatus to an actuator of the actuation system.
Figure 8B:
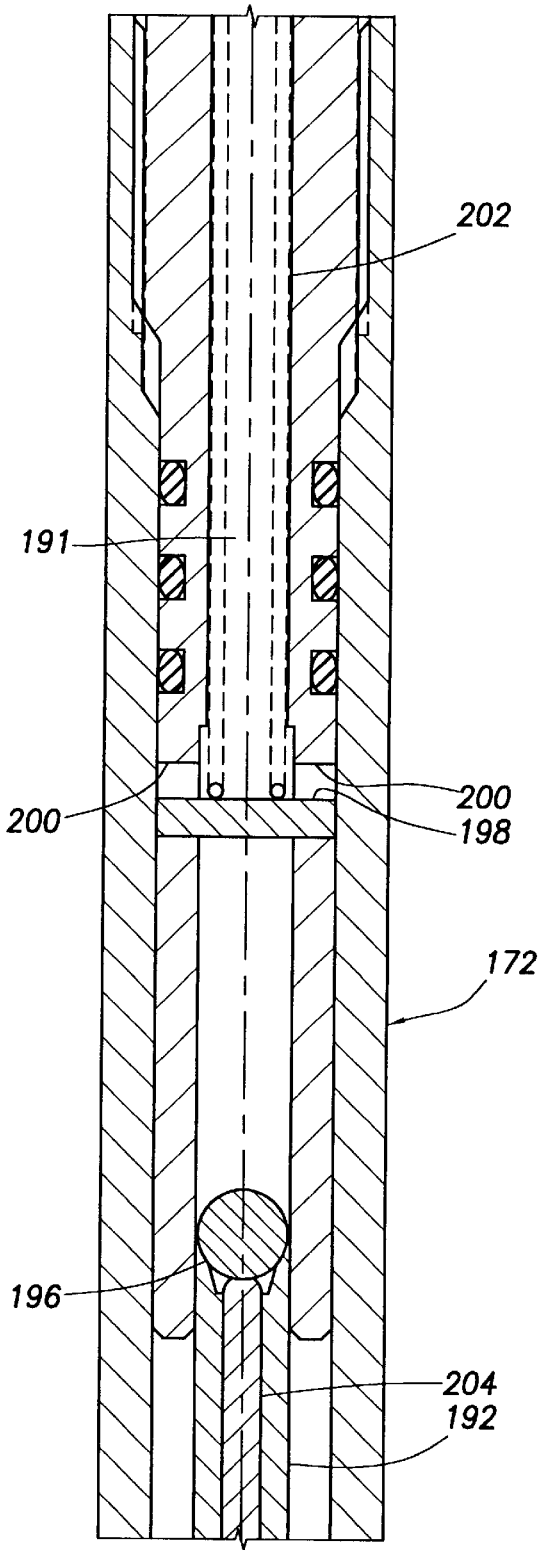
Figure 8C:
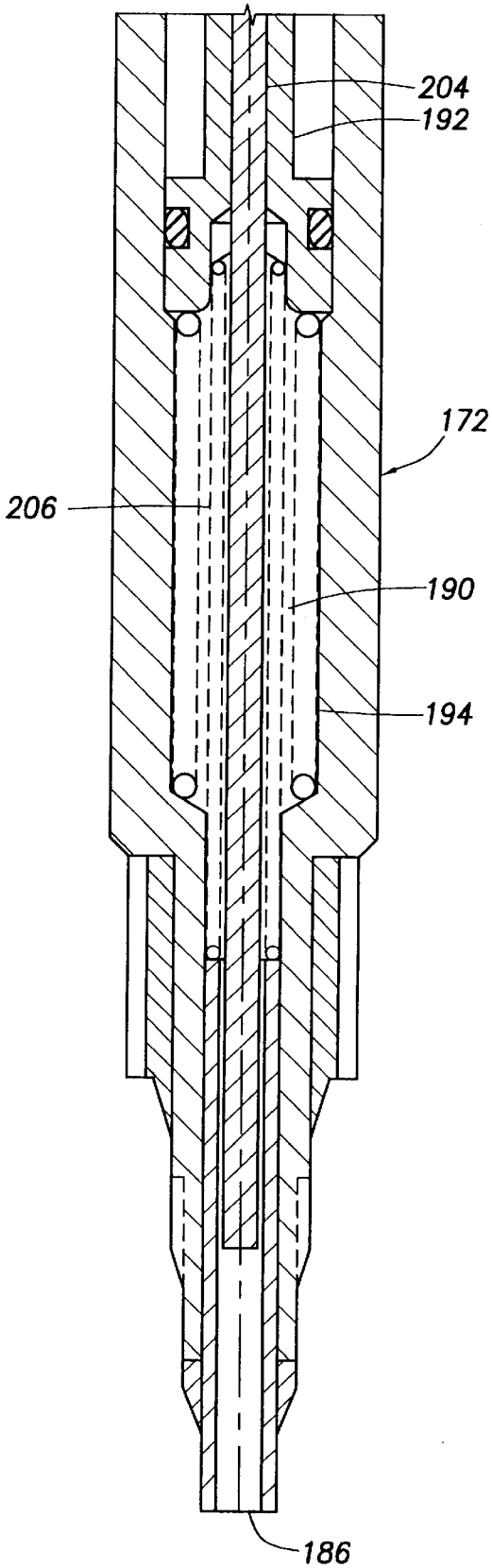

Referring additionally now to FIGS. 8A–C, the fluid metering apparatus 172 is depicted in its configuration after pressure has been applied to the input port 188. The piston 192 has been downwardly displaced, along with the check valve 196. Thus, the known volume of fluid has been discharged from the chamber 190 via the output port 186, and another known volume of fluid has been received in the chamber 191 from the input port 188.

Note that the upwardly biasing forces of both of the springs 194, 206 are overcome to displace the piston 192 downwardly. Therefore, these biasing forces may be adjusted as desired to set a minimum actuation pressure which must be applied to the input port 188 to discharge the known volume of fluid from the apparatus 172. Note, also, that the check valve 196 remains closed, due to the pressure differential thereacross, as the piston 192 displaces downward, even though the downwardly biasing force of the spring 202 is no longer exerted on the check valve via the pin 198.

Figure 9A:
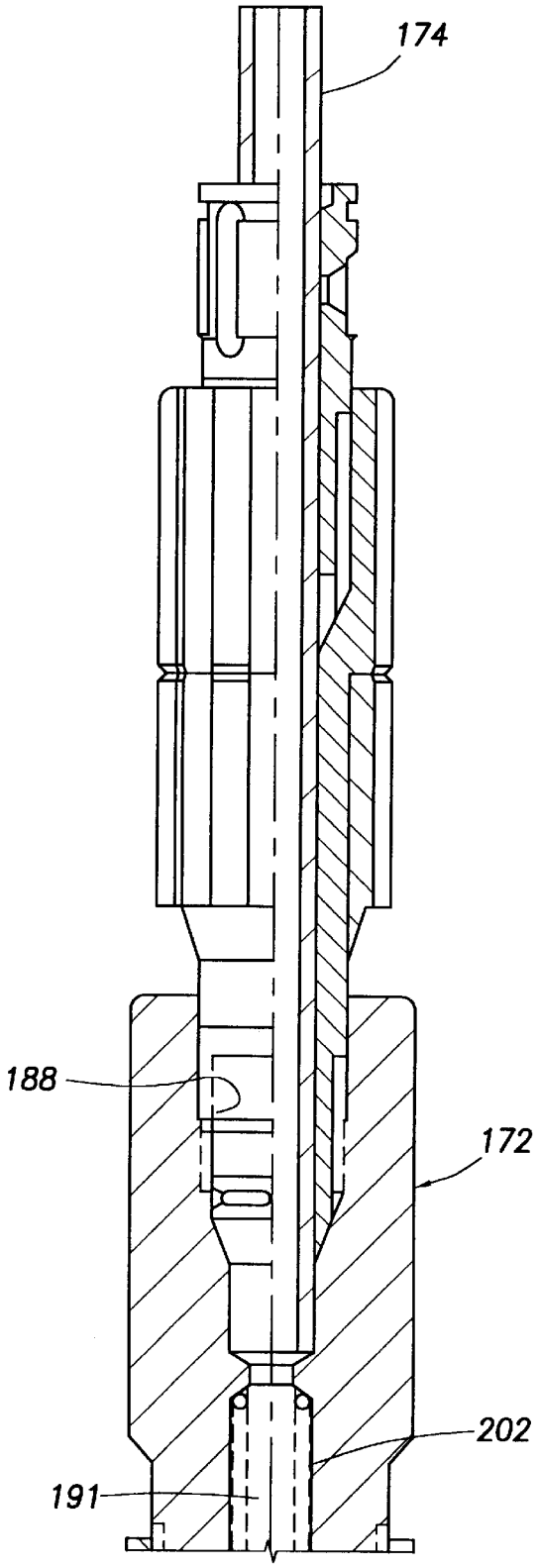
FIGS. 9A–C are enlarged cross-sectional views of the fluid metering apparatus of the actuation system of FIGS. 6A–D, the apparatus being shown in a configuration in which the apparatus is prepared to accept another known volume of fluid therein.
Figure 9B:
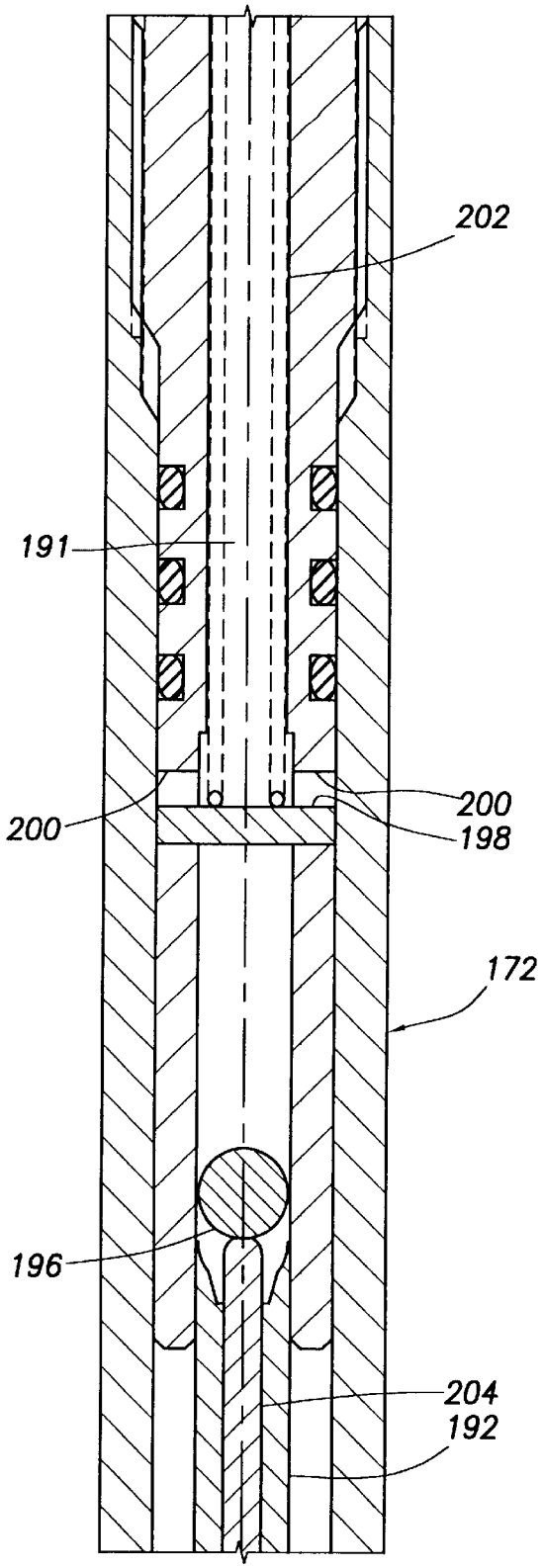
Figure 9C:
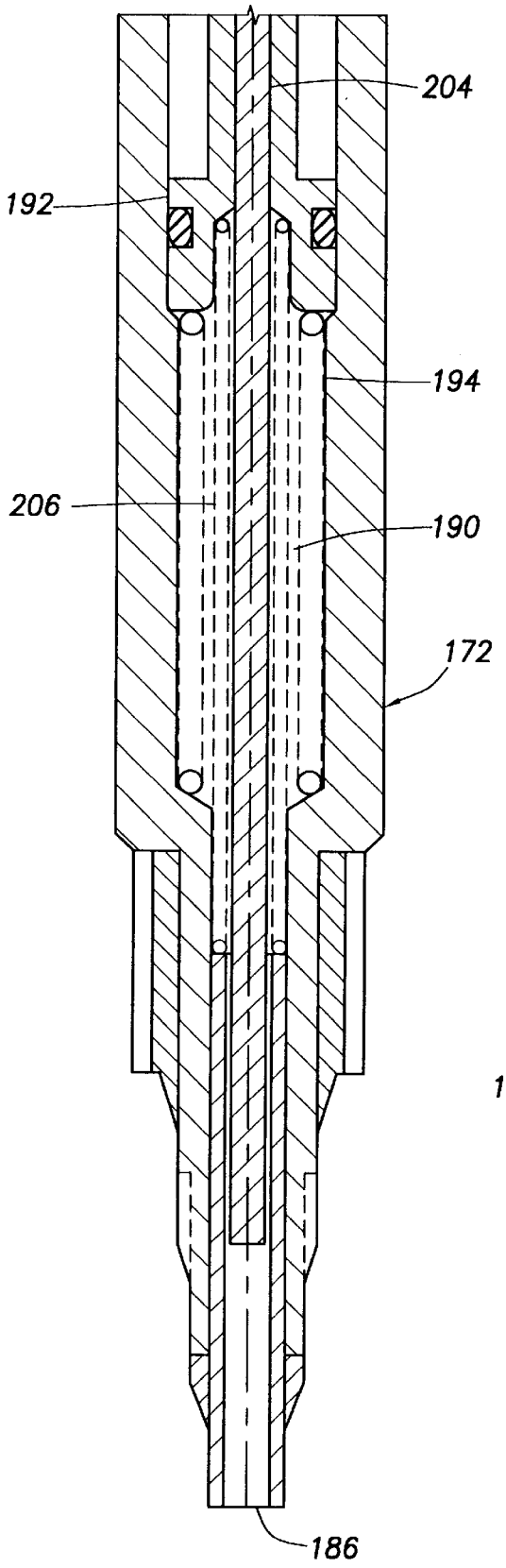

Referring additionally now to FIGS. 9A–C, the fluid metering apparatus 172 is representatively illustrated in its configuration after the pressure applied to the input port 188 has been at least partially relieved. At this point, the pressure differential across the check valve 196 is insufficient to overcome the upwardly biasing force of the spring 206. Thus, the spring 206 has displaced the rod 204 upwardly relative to the piston 192 and has thereby opened the check valve 196 to fluid flow therethrough in a downward direction as viewed in FIG. 9B.

Therefore, after the known volume of fluid has been discharged from the chamber 190, the check valve 196 is opened by reducing the pressure applied to the input port 188. It will be readily appreciated that the biasing force exerted by the spring 206 may be adjusted to produce a desired pressure differential at which displacement of the rod 204 will open the check valve 196.

Figure 10A:
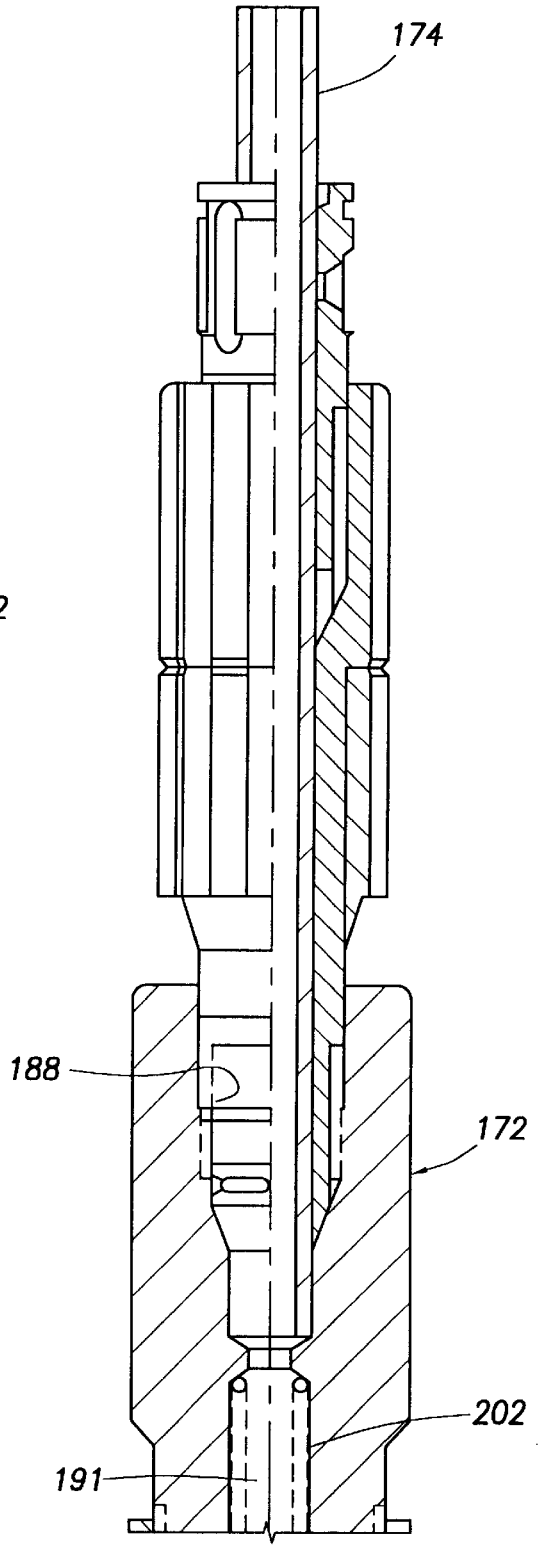
FIGS. 10A–C are enlarged cross-sectional views of the fluid metering apparatus of the actuation system of FIGS. 6A–D, the apparatus being shown in a configuration in which another volume of fluid has been received therein.
Figure 10B:
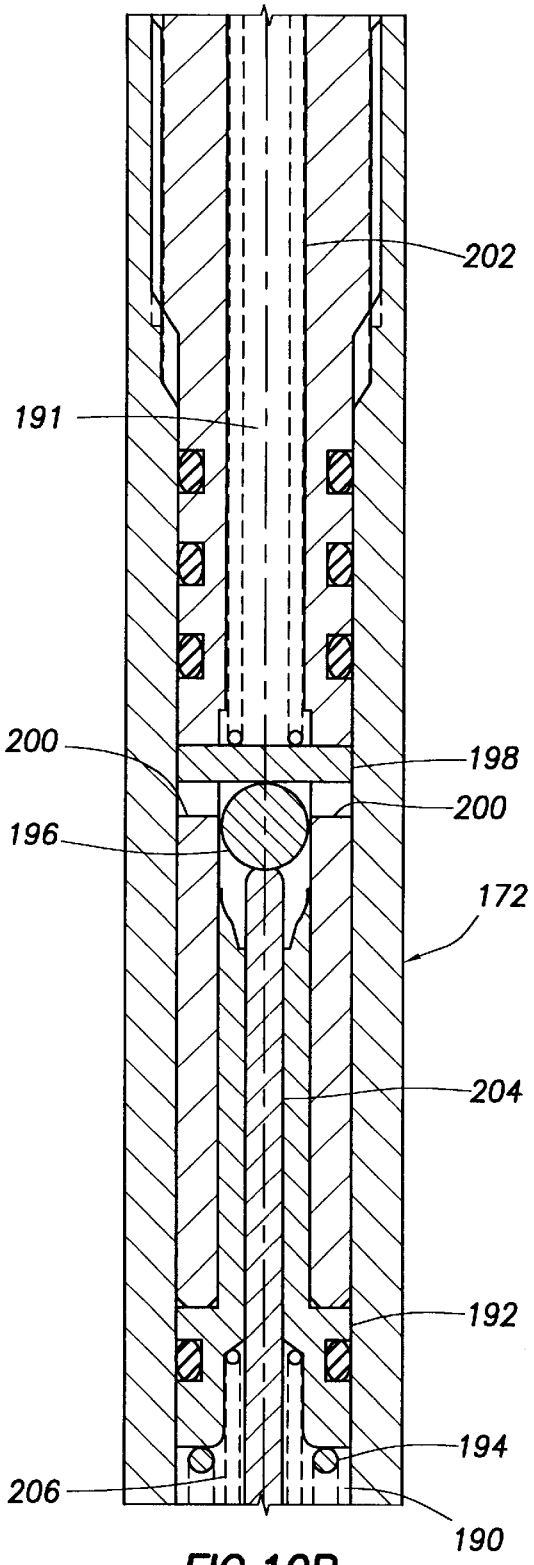
Figure 10C:
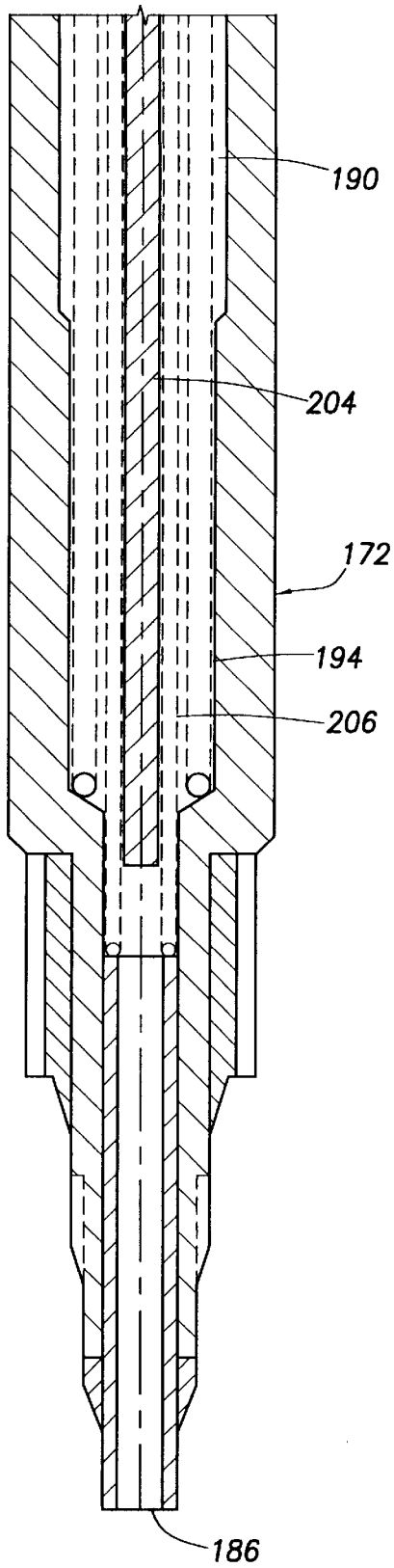

Referring additionally now to FIGS. 10A–C, the fluid metering apparatus is representatively illustrated in its configuration after the pressure applied to the input port 188 has been completely relieved, or at least sufficiently relieved to permit the biasing forces of the springs 194, 206 to upwardly displace the piston 192 and check valve 196. The piston 192 has displaced upward with the check valve 196 open, thereby receiving another known volume of fluid into the chamber 190. At that point, the apparatus 172 would be returned to its configuration as shown in FIGS. 7A–C, and pressure could again be applied to the input port 188 to discharge the next known volume of fluid from the apparatus.

However, as depicted in FIGS. 10A–C, pressure has been applied to the other hydraulic line 184 of the actuation system 170 (See FIGS. 6A–D), causing the piston 178 to displace downwardly and applying the pressure to the output port 186 of the apparatus 172. This pressure applied to the output port 186 is communicated in the apparatus 172 to the check valve 196, where the resulting pressure differential across the check valve opens the check valve against the downwardly biasing force of the spring 202. It will be readily appreciated that the force exerted by the spring 202 may be adjusted to set a desired pressure differential across the check valve 196 at which the check valve opens.

With the check valve 196 open as depicted in FIG. 10B, fluid may flow from the output port 186 to the input port 188, permitting the piston 178 of the actuator 176 to displace downwardly and close, or at least increasingly restrict fluid flow through, the Interval Control Valve. When the pressure is relieved from the hydraulic line 184, the pressure differential across the check valve 196 from the chamber 190 to the chamber 191 will be eliminated, and the check valve 196 will close. At that point, the apparatus 172 will be returned to its configuration as depicted in FIGS. 7A–C, and the apparatus 172 will again be ready for discharging the known volume of fluid therefrom.

The fluid metering apparatus 172 may be used in conjunction with well tools and actuators other than the actuator 176 and the Interval Control Valve as described above. Additionally, the apparatus 172 may be differently configured, may be otherwise connected to an actuator, and may be otherwise operated, without departing from the principles of the present invention. For example, one of the apparatus 172 could be additionally, or alternatively, interconnected between the hydraulic line 184 and the chamber 182 of the actuator 176, so that the Interval Control Valve could be incrementally closed by applying pressure to the hydraulic line 184.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of metering a known volume of fluid into an actuator for a well tool positioned in a subterranean well, the method comprising the steps of:

interconnecting a hydraulic output of a fluid metering apparatus to a hydraulic input of the actuator;

applying pressure to only a single hydraulic input of the fluid metering apparatus; and discharging the known volume of fluid from the fluid metering apparatus output in response to the pressure applying step.

2. The method according to claim 1, further comprising the step of repeating the pressure applying and discharging steps to thereby incrementally displace a piston of the actuator.

3. A fluid metering apparatus for use in a subterranean well, the apparatus comprising:

a piston;

first and second chambers on opposite sides of the piston;

a hydraulic input in fluid communication with the first chamber, the piston displacing in response to pressure on the hydraulic input;

a hydraulic output in fluid communication with the second chamber; and a valve responsive to displacement of the piston, the valve selectively permitting and preventing fluid communication between the first and second chambers.

4. A fluid metering apparatus for use in a subterranean well, the apparatus comprising:

a piston;

first and second chambers on opposite sides of the piston;

a hydraulic input in fluid communication with the first chamber;

a hydraulic output in fluid communication with the second chamber;

a valve responsive to displacement of the piston, the valve selectively permitting and preventing fluid communication between the first and second chambers; and a latching device, the latching device securing the valve in an open configuration when the piston has displaced from a first position to a second position thereof, and the latching device permitting the valve to close after the piston has displaced from the second to the first position.

5. The apparatus according to claim 4, wherein the piston discharges fluid from the second chamber to the output when the piston displaces from the first to the second position.

6. The apparatus according to claim 5, wherein fluid flows from the first to the second chamber when the piston displaces from the second to the first position.

7. The apparatus according to claim 5, wherein fluid flows from the input to the first chamber when the piston displaces from the first to the second position.

8. The apparatus according to claim 4, wherein the valve is disposed at least partially within the piston, the valve displacing at least partially with the piston.

9. The apparatus according to claim 4, wherein the valve engages an abutment when the piston displaces from the first to the second position, the engagement with the abutment permitting the valve to be opened and causing the latching device to secure the valve in the open configuration when the piston displaces from the second to the first position.

10. The apparatus according to claim 4, wherein the latching device engages an abutment when the piston displaces from the second to the first position, the valve closing in response to the engagement of the latching device with the abutment.

11. A method of metering a known volume of fluid into an actuator for a well tool positioned in a subterranean well, the method comprising the steps of:

interconnecting a hydraulic output of a fluid metering apparatus to a hydraulic input of the actuator; and applying pressure to a hydraulic input of the fluid metering apparatus, thereby displacing a piston of the fluid metering apparatus while a valve of the fluid metering apparatus is closed, admitting fluid from the fluid metering apparatus input into a first chamber of the fluid metering apparatus, and discharging the known volume of fluid from a second chamber of the fluid metering apparatus to the fluid metering apparatus output.

12. The method according to claim 11, further comprising the steps of relieving pressure on the fluid metering apparatus input, and opening the valve in response to the pressure relieving step.

13. The method according to claim 12, wherein the opening step further comprises displacing at least a portion of the piston relative to at least a portion of the valve.

14. The method according to claim 12, wherein the opening step further comprises operating a latching device of the fluid metering apparatus to thereby secure the valve in an open configuration.

15. The method according to claim 12, further comprising the step of displacing the piston in response to the pressure relieving step, the piston displacing while the valve is open.

16. The method according to claim 15, wherein the relieving pressure step further comprises closing the valve in response to displacement of the piston.

17. The method according to claim 16, wherein the closing step further comprises engaging an abutment of the fluid metering apparatus, the engagement with the abutment closing the valve.

18. The method according to claim 16, wherein the closing step further comprises operating a latching device of the fluid metering apparatus to thereby permit the valve to close.

19. A fluid metering apparatus for use in a subterranean well, the apparatus comprising:

a housing having a bore formed therein;

a piston reciprocably received in the bore, the piston sealingly engaging the bore at a first diameter and defining first and second chambers on opposite sides of the piston, and the piston being sealingly engageable with the housing at a second diameter smaller than the first diameter;

first and second hydraulic inputs, the second input being in fluid communication with the first chamber;

first and second hydraulic outputs, the first output being in fluid communication with the first input;

a first check valve permitting fluid flow from the first input and the first output to the second chamber, but preventing fluid flow from the second chamber to the first input and first output; and a second check valve preventing fluid flow from the second input and the second output to the second chamber, but permitting fluid flow from the second chamber to the second input and the second output.

20. The apparatus according to claim 19, further comprising a third check valve permitting fluid flow from the second output to the second input, but preventing fluid flow from the second input to the second output.

21. The apparatus according to claim 20, further comprising a flow restrictor substantially restricting fluid flow between the second input and the second output.

22. The apparatus according to claim 19 wherein, when the piston is sealingly engaged at the second diameter, the second check valve is in fluid communication with the second chamber between the first and second diameters, and the first check valve is in fluid communication with the second chamber opposite the second diameter from the first diameter.

23. The apparatus according to claim 19 wherein, when the piston is sealingly engaged at the second diameter, such sealing engagement prevents fluid communication between the first and second check valves.

24. The apparatus according to claim 19, wherein fluid pressure applied to the second input displaces the piston, thereby forcing fluid in the second chamber to flow out the second output.

25. The apparatus according to claim 19, wherein fluid pressure applied to the second input displaces the piston to sealingly engage the housing at the second diameter.

26. The apparatus according to claim 19, wherein fluid pressure applied to the first input greater than fluid pressure at the second input when the piston is not sealingly engaged at the second diameter displaces the piston, thereby increasing the volume of the second chamber.

27. The apparatus according to claim 26, wherein fluid pressure applied to the first input less than a predetermined amount greater than fluid pressure at the second input when the piston is sealingly engaged at the second diameter causes the piston to remain stationary.

28. The apparatus according to claim 27, wherein fluid pressure applied to the first input at least the predetermined amount greater than fluid pressure at the second input when the piston is sealingly engaged at the second diameter displaces the piston, thereby eliminating the sealing engagement between the piston and the housing at the second diameter.

29. A method of metering a known volume of fluid into an actuator for a well tool positioned in a subterranean well, the method comprising the steps of:

interconnecting first and second hydraulic outputs of a fluid metering apparatus to respective first and second hydraulic inputs of the actuator, the fluid metering apparatus first output being in fluid communication with a first chamber on one side of a piston of the actuator, and the fluid metering apparatus second output being in fluid communication with a second chamber on an opposite side of the actuator piston;

applying pressure to a first hydraulic input of the fluid metering apparatus, thereby displacing the known volume of fluid from the fluid metering apparatus first hydraulic input into a first chamber of the fluid metering apparatus; and applying pressure to a second hydraulic input of the fluid metering apparatus, thereby displacing the known volume of fluid from the fluid metering apparatus first chamber into the actuator second chamber, and thereby displacing the actuator piston.

30. The method according to claim 29, wherein in the interconnecting step, the fluid metering apparatus second input is in fluid communication with the fluid metering apparatus second output.

31. The method according to claim 30, wherein in the interconnecting step, a check valve permits fluid flow from the fluid metering apparatus second output to the fluid metering apparatus second input.

32. The method according to claim 31, wherein in the interconnecting step, a flow restrictor substantially restricts fluid flow between the fluid metering apparatus second output and the fluid metering apparatus second input.

33. The method according to claim 29, wherein in the step of applying pressure to the fluid metering apparatus first input, the actuator piston is pressure balanced by providing fluid communication in the fluid metering apparatus between the first and second outputs thereof.

34. The method according to claim 33, wherein in the fluid communication providing step, a first check valve permits fluid flow from a first passage of the fluid metering apparatus providing fluid communication between the fluid metering apparatus first output and the fluid metering apparatus first input to the fluid metering apparatus first chamber.

35. The method according to claim 34, wherein in the fluid communication providing step, a second check valve permits fluid flow from the fluid metering apparatus first chamber to a second passage of the fluid metering apparatus providing fluid communication between the fluid metering apparatus second output and the fluid metering apparatus second input.

36. The method according to claim 35, wherein in the fluid communication providing step, a third check valve permits fluid flow from the fluid metering apparatus second output to the fluid metering apparatus second input through the second passage.

37. The method according to claim 29, wherein the step of applying pressure to the fluid metering apparatus second input further comprises preventing fluid communication between the fluid metering apparatus first and second outputs in response to the application of pressure to the fluid metering apparatus second input.

38. The method according to claim 29, further comprising the step of applying pressure to the fluid metering apparatus first input while pressure is applied to the fluid metering apparatus second input, thereby displacing fluid from the fluid metering apparatus first output to the actuator first chamber and displacing fluid from the actuator second chamber to the fluid metering apparatus second output.

39. The method according to claim 38, wherein in the step of applying pressure to the fluid metering apparatus first input while pressure is applied to the fluid metering apparatus second input, pressure applied to the fluid metering apparatus first input is greater than pressure applied to the fluid metering apparatus second input.

40. The method according to claim 38, wherein the step of applying pressure to the fluid metering apparatus first input while pressure is applied to the fluid metering apparatus second input further comprises displacing fluid from the fluid metering apparatus second output to the fluid metering apparatus second input.

41. A fluid metering apparatus for use in a subterranean well, the apparatus comprising:

a piston;

first and second chambers on opposite sides of the piston;

a hydraulic input in fluid communication with the first chamber;

a hydraulic output in fluid communication with the second chamber; and a check valve being closed when a first pressure differential from the first chamber to the second chamber displaces the piston in a first direction and discharges fluid from the output.

42. The apparatus according to claim 41, wherein the check valve is open when the piston displaces in a second direction opposite to the first direction.

43. The apparatus according to claim 42, wherein the piston discharges fluid from the second chamber to the output when the piston displaces in the first direction.

44. The apparatus according to claim 43, wherein fluid flows from the first to the second chamber when the piston displaces in the second direction.

45. The apparatus according to claim 43, wherein fluid flows from the input to the first chamber when the piston displaces in the first direction.

46. The apparatus according to claim 42, wherein the check valve displaces at least partially with the piston.

47. The apparatus according to claim 42, wherein the the check valve opens in response to a second pressure differential from the first chamber to the second chamber, the second pressure differential being less than the first pressure differential.

48. The apparatus according to claim 47, wherein the check valve opens in response to a third pressure differential from the second to the first chamber.

* * * * *